US005779566A

United States Patent [19]

Wilens

[11] Patent Number: 5,779,566

[45] Date of Patent: Jul. 14, 1998

[54] HANDHELD GOLF REPORTING AND STATISTICAL ANALYSIS APPARATUS AND METHOD

[76] Inventor: Peter S. Wilens, 2331 Cheswick, Troy, Mich. 48084

[21] Appl. No.: 392,280

[22] Filed: Feb. 22, 1995

Related U.S. Application Data

[63] Continuation-in-part of Ser. No. 58,074, May 4, 1993, abandoned.

[51] Int. Cl.[6] ..... G06F 15/44; A63F 9/22

[52] U.S. Cl. ..... 473/407; 473/409; 473/131

[58] Field of Search ..... 473/150–156, 473/140–141, 407, 409; 364/410–411, 709.01–709.02, 709.1, 709.11, 709.12; 345/123, 121, 124, 125, 169, 173, 145, 146; 340/323 R; 273/DIG. 26, DIG. 28; 235/145 R, 145 A; 341/22, 35; 400/100, 486

[56] References Cited

U.S. PATENT DOCUMENTS

| | | | |
|---|---|---|---|
| 4,714,919 | 12/1987 | Foster | 345/123 |
| 4,744,046 | 5/1988 | Foster | 345/123 |
| 4,974,183 | 11/1990 | Miller | 400/486 |
| 4,977,503 | 12/1990 | Rudnick et al. | 364/410 |
| 5,006,001 | 4/1991 | Vulcano | 400/486 |
| 5,127,044 | 6/1992 | Bonito et al. | 473/407 |
| 5,245,537 | 9/1993 | Barber | 364/410 |
| 5,270,689 | 12/1993 | Hermann | 345/145 |
| 5,294,110 | 3/1994 | Jenkins et al. | 473/407 |
| 5,319,548 | 7/1994 | Germain | 364/410 |
| 5,364,093 | 11/1994 | Huston et al. | 473/407 |
| 5,458,425 | 10/1995 | Torok | 400/486 |
| 5,469,175 | 11/1995 | Boman | 473/407 |

*Primary Examiner*—Jessica Harrison
*Assistant Examiner*—Mark A. Sager
*Attorney, Agent, or Firm*—Young & Basile, P.C.

[57] ABSTRACT

A handheld computerized golf data recording, reporting and advising unit, and a method for its operation. The unit itself is a small, comfortably handheld computerized unit with a generally writable display and a simplified key control panel to enter and retrieve data. Using the key control panel, a golfer can selectively retrieve a number of pre-formatted screens corresponding to pre-game, game-interactive and post-game recording and reporting of golf facts statistics and general golf knowledge. The pre-game screens contain data input fields having predetermined sets of values a user selects to provide information required by the game-interactive and game-reporting screens and algorithms to process, store and report information. The information entered in the pre-game and game-interactive mode is automatically stored in the memory of the unit and subsequently formatted into one or more statistical reports upon request by the user.

37 Claims, 36 Drawing Sheets

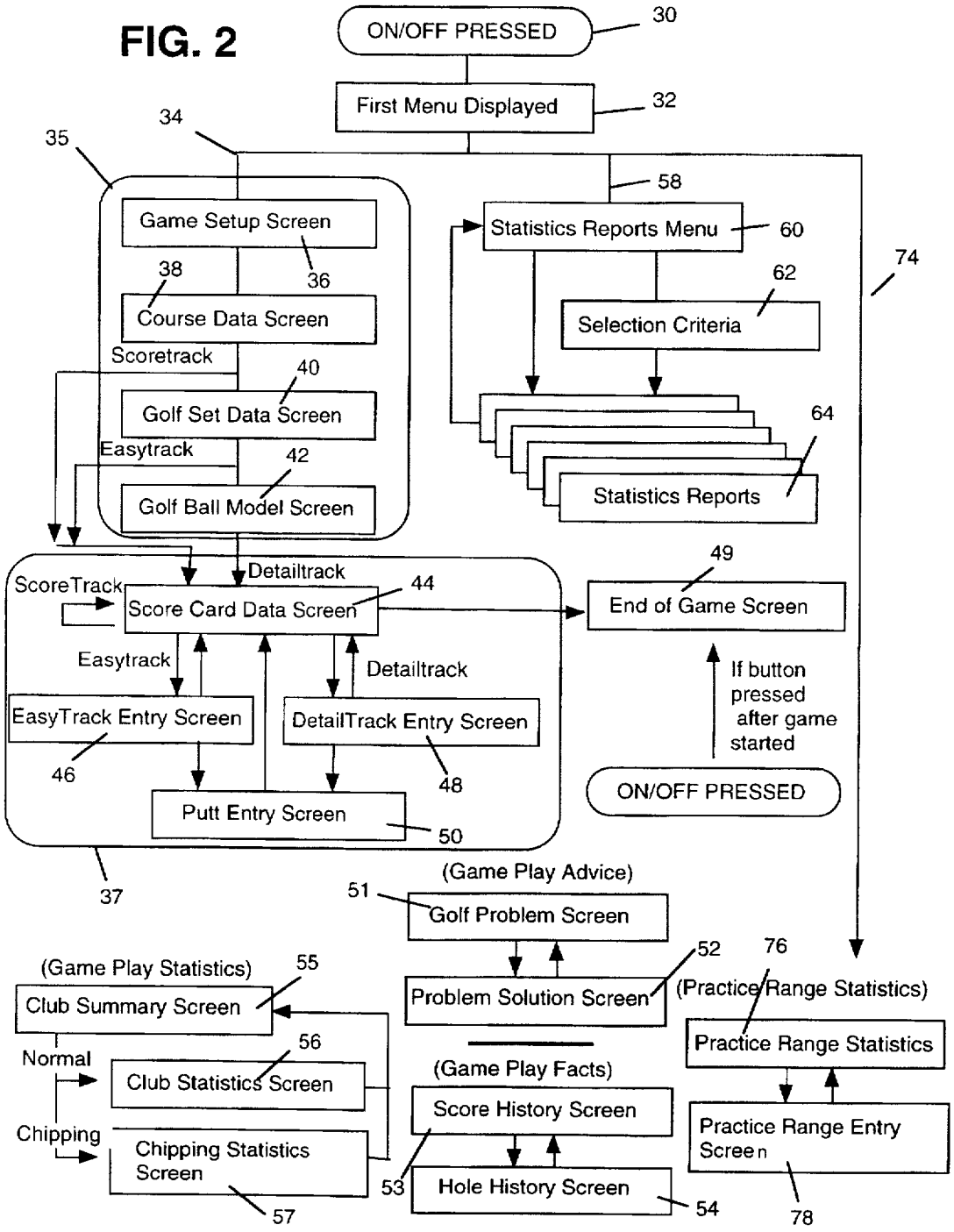
FIG. 2
ON/OFF PRESSED
30
First Menu Displayed
32
34
35
58
Game Setup Screen
Statistics Reports Menu
60
74
38
36
62
Course Data Screen
Selection Criteria
Scoretrack
40
Golf Set Data Screen
64
Easytrack
42
Statistics Reports
Golf Ball Model Screen
49
Detailtrack
ScoreTrack
44
Score Card Data Screen
End of Game Screen
Easytrack
Detailtrack
If button pressed after game started
EasyTrack Entry Screen
DetailTrack Entry Screen
46
48
ON/OFF PRESSED
Putt Entry Screen
50
37
(Game Play Advice)
51
Golf Problem Screen
52
76
(Game Play Statistics)
55
Club Summary Screen
Problem Solution Screen
(Practice Range Statistics)
Practice Range Statistics
Normal
56
Club Statistics Screen
(Game Play Facts)
Score History Screen
Practice Range Entry Screen
Chipping
Chipping Statistics Screen
53
Hole History Screen
54
57
78

HANDHELD GOLF REPORTING AND STATISTICAL ANALYSIS APPARATUS AND METHOD

This is a continuation-in-part of application Ser. No. 08/058,074 filed on May 4, 1993 now abandoned.

FIELD OF THE INVENTION

The present invention is related to an apparatus and method for reporting and recording golf information and for providing golf advice and feedback in real time, and more particularly to a handheld computer unit and method for recording and reporting golf information.

BACKGROUND OF THE INVENTION

In golf, like in many games, there is substantial information which can be traced to measure a player's progress, and hopefully improvement, over a period of time. Such facts and statistics invariably include scores, as well as less commonly-organized criteria such as tendencies in certain situations to score or perform in a particular manner, preferred playing conditions, and others depending on the sport or game. Players can, and often do, try to improve themselves by studying their past performances for strengths and weaknesses.

Golf in particular, although not exclusively, lends itself to the careful study of past performance in order to improve one's game. This is in part due to the myriad number of factors which need to be taken into account to accurately gauge performance; e.g., overall score, score per hole, club accuracy and yardages under different weather and ground conditions; performance in and out of hazards; performance based on ball model number and compression rating; length of hole; hole and total course par values; course difficulty; club set used; the player's tendency to slice or hook with particular clubs; etc. Most golfers will agree that the game of golf is complicated, subtle, and best mastered through diligent practice and careful study.

To date, however, the study part of the game of golf, learning from past performances, has not been approached in a systematic, comprehensive manner. Most golfers until now have relied on intuition, memory, or rough pen and paper techniques. The shortcomings of these manual, intuitive methods have been noted by the prior art, and addressed with some primitive electronic or computerized devices for aiding the golfer in his game.

U.S. Pat. No. 4,815,020 to Cormier discloses an apparatus and method for determining the remaining distance to the green and for selecting an appropriate club to use for that shot. This includes a portable electronic data entry and retrieval unit connected to a mechanical or electrical counter which measures the distance a manual golf cart's wheels travel over the ground between shots. The memory in the unit stores data representing prior performance with each club in the golfer's set, and the yardage along a golf course. It includes an angle measuring device for shots which do not travel straight toward the hole. Using trigonometric algorithms stored in the unit's memory, the device counts off the distance traveled by the cart between each shot and determines the remaining distance to the green. The golfer can enter the club used and approximate distance for each shot in order to update the performance data stored in the memory. In response to an operator query, the unit will list one or more club performance values to help the golfer select a club for the next shot.

U.S. Pat. No. 4,142,236 to Martz et al discloses an electronic golf scorecard which has a memory to store golf course data and player scores for one or more players. The unit displays individual score subtotals or totals for each golfer whose strokes are recorded during the game.

U.S. Pat. No. 4,266,214 to Peters, Jr. discloses an electronic game scoring device, for example for use with golf, in a small, portable hand-held housing. As applied to the game of golf, it envisions use of a prerecorded magnetic card containing data about a particular course to be read into the unit's memory before a game.

The above prior art devices, while useful, are limited in the scope of their functions, and in fact are not much more than electronic score cards or, in the case of U.S. Pat. No. 4,815,020, electronic pace counters with very limited statistical averaging functions. Their high number of keys, non-intuitive user interfaces, and small displays capable only of displaying limited amounts of information make them less than ideal.

SUMMARY OF THE INVENTION

The present invention is a greatly improved handheld computer unit for recording and reporting sports information, for example golf information, and a method for entering and retrieving data. The flexibility, function and information recording and reporting methodology of the present invention go far beyond the limitations of the prior art.

In its most basic form the inventive apparatus is a comfortably handheld, self-contained computer unit having a non-volatile memory, a power source, a general output display for selectively displaying a plurality of informational screens stored in the memory, and a program that determines logical screen and information sequence and processes the data entered. The unit is provided with key entry means for retrieving and selectively displaying various screens from the memory on the display, and for entering game data into each screen to be stored in the memory. The provision of a general output display, the variety of specialized screens for organization of data, and the handheld portability of the invention result in a device with nearly unlimited potential.

Because the display of the handheld unit provides preformatted screens in which data input fields are logically organized and displayed, the key entry means of the unit is greatly simplified. Since each screen as it appears on the display is already provided via the computer memory with a set of data fields, each with a set of values to choose from, a comprehensive and intuitive golfer interface is achieved with only a first key set for selectively choosing screens to be displayed; a second tab key set for selectively choosing a particular data field on the displayed screen; and, a third scroll key set for entering or altering data in that particular field. In effect, the golfer has only three types or sets of keys to operate for full control of the unit's recording and reporting methodology.

In yet a further embodiment, the first key entry set includes two keys, one a sequential screen-changing key which, with each press, causes the computer to display the next logical screen of a series of screens. For example, when the unit is first turned on, a game setup screen appears. When the golfer has completed entry of all appropriate data input fields on that screen, pressing this sequential selection key takes the golfer to the next logical screen in the progression, for example a course data screen. At the same time, the data in the previously completed screen is stored in the computer memory for later retrieval and display. In this manner the player can cycle through a series of screens in a logical predetermined order for efficient data entry both before, during and after the golf game. In a preferred form, the user may specify the amount of data he wishes to record and subsequently report on by initially selecting one of a plurality of game recording modes. In turn, this selection will define the order of display of subsequent pre-game and game-interactive screens. Generally speaking, the greater the amount of detail and statistical information required by a user, the more information (and thus screens) he must enter during golf play.

Since information is recorded only once, during the course of play while still fresh in the mind of the player, the information is more likely to be accurate. Moreover, the information need not be re-recorded after the game as may be necessary with less portable, less comprehensive devices.

The second screen-changing key is non-sequential in operation and allows the golfer to break out of the predetermined sequence of screens controlled by the sequential entry key as needed. In a preferred form the operation of this non-sequential screen-changing key is screen-dependent, in that the available choices of alternate screens will vary to logically complement the currently-displayed screen.

Because a general output display is used, all available screens are pre-formatted or "customized" to perform a particular recording or reporting function. The flexibility or number of specific reporting/recording functions is accordingly nearly unlimited; however, the method for inputting data on each different screen is generally the same, facilitating ease of use.

As each screen is displayed it contains one or more data input fields, each with an associated plurality or range of data values which may be scrolled through and selected. For example, on a scorecard screen the field for a golfer's score contains a set of values from 0 to, e.g., 16. When the hole is finished the golfer can scroll through the values in that field and select the number corresponding to his score for that hole.

The method for tabbing from field to field on a particular screen requires only two tab keys, tab forward and tab back to permit the golfer to tab through each field on the screen from beginning to end as the game demands. Likewise, only two scroll keys are necessary for selecting values for a chosen field, permitting the golfer to scroll up or down the range of values provided by the program. When the correct value is chosen, the player simply tabs to the next field.

The above-described handheld apparatus and method of its operation results in a clear, easy to use system. Relative to the handheld apparatus and method of physical operation, the screen display and sequencing methodology both complements the handheld unit and greatly increases its flexibility and usefulness.

The memory of the handheld unit is provided with a number of pre-game, game-interactive and post-game screens, each screen designed to fit on the generally-writable display of the handheld unit to comprehensively address a particular facet of the game. The computer unit is programmed to provide these in an orderly sequence which aids the golfer in preparing for, playing and reviewing a game of golf.

When the unit is first turned on, the player selects a game recording or statistical reporting mode or module. All information recorded for a particular game in the game recording mode is stored in the memory during the game, for subsequent statistical reporting via the statistical reporting module. Statistical reporting is done automatically based upon earlier entered data, and requires no calculation or additional operation of the unit or entry of data by the player other than what was done in the game recording module. Furthermore, select statistical reports are available during course play to assist the user in selecting clubs. In one embodiment of the present invention, for example, club-selection assistance reports are provided which are based on an evaluation of the relationship between current game performance and extrinsic factors affecting play, such as weather, temperature, time of day, ball model/compression data, and similar relevant data.

When the unit is turned on and the game recording module selected, one or more pre-game screens sequentially appear in logical order to request selection or definition of pre-game parameters such as the names of the players, information on the golf course to be played, the clubs being used, and the level of detail to be recorded by the golfer.

When the pre-game screens have been filled in, the unit next displays one or more game-interactive screens corresponding to one of several game-interactive reporting modes, either chosen by default or by the golfer during the pre-game mode. In a particular embodiment of the invention the game-interactive reporting modes include a simple one screen "scorecard" mode, an "easy track" mode providing additional detail, and a "detail track" mode in which the screen(s) is set up for recording a most-detailed set of data.

In a preferred embodiment control is initially passed to the scorecard screen after the pre-game screens have been updated, regardless of the game-interactive mode selected. Each game-interactive mode therefore consists of at least the scorecard screen and possibly one or more additional screens, depending on the mode selected.

While the illustrated embodiment describes three game-interactive modes, it will be understood by those skilled in the art that the number is dependent on the desire of the programmer or the sport for which the unit is adapted.

Depending on the game-interactive reporting mode selected by the player, additional pre-game screens requesting further setup data may be displayed and the information carried over into the game-interactive screen(s). Where the chosen level of recording detail is high, for example, the golfer will be prompted to enter data relating to a variety of extrinsic factors having an effect on a golf game, such as weather conditions, temperature, wind, golf ball compression data, and the like.

Player performance is impacted by both the player's skill and the extrinsic factors that may interfere with or enhance a player's shots during the course of a game. Player performance includes such tracked statistics as average distance per golf club, number of putts per hole, overall score and the like. Extrinsic factors include environmental dimensions, for example temperature, ground conditions, date and time, golf ball compression and golf ball model number, to name a few. While player's skill most directly impacts game performance, extrinsic factors have an effect on player performance to the extent that they interfere with or compliment player's skill; for example, experienced players understand that shot distance with a given club will commonly vary given different extrinsic factors such as weather and temperature, ground conditions, golf ball compression and model number, or even the time of day.

Player performance and extrinsic factor data is stored in the apparatus of the present invention in such a manner as to preserve relationships between player performance data and extrinsic factor data to provide a subsequent report to the player.

Accordingly, and a further aspect of the invention and apparatus and method are provided for recording and reporting player performance, selected extrinsic factors tending to affect player performance, and the relationship of extrinsic factors on player performance. In a further embodiment of the invention an apparatus and method are provided to assist a player in selecting clubs during game play in view of the relationship between extrinsic factors and player performance. Prior to game play, for example, information is provided to allow a player to make informed performance-effecting decisions such as the best time of day to play, the best golf ball, compression to use, or the most ideal ground conditions, for example. During game play, the invention provides a means to record player performance and to assist a player in selecting the most appropriate golf club for each shot considering the players club skill and the effect of extrinsic factors on performance with each club. After game play, invention provides a player with a comprehensive set of historical detail and summary information on performance, including the effect of extrinsic factors on performance.

In the pre-game and game-interactive modes, each screen has an associated "choice screen" listing a number of operational screen selections or "choices" to which the golfer can resort by pressing the non-sequential screen-changing key described above. In most or all of the choice screens the player is given at least the choice of returning to the beginning of the game, or ending the game. In game-interactive mode, for example, each game-interactive screen has an associated choice screen provided with options to choose from such as a screen which helps the player select a club, general golf advice for particular types of shots, review of pre-game data, etc. The choices or optional screens are context-sensitive in that they are appropriately tailored to the displayed screen. For example, advice on golf technique is available during course play in the game-interactive mode when it is needed most.

These and other features and advantages of the present invention will become apparent upon further reading of the specification.

BRIEF DESCRIPTION OF THE DRAWINGS

FIG. 2 is a flow diagram of the sequence of screen selection/display in the unit of FIG. 1;

DETAILED DESCRIPTION OF THE ILLUSTRATED EMBODIMENT

Figure 1:
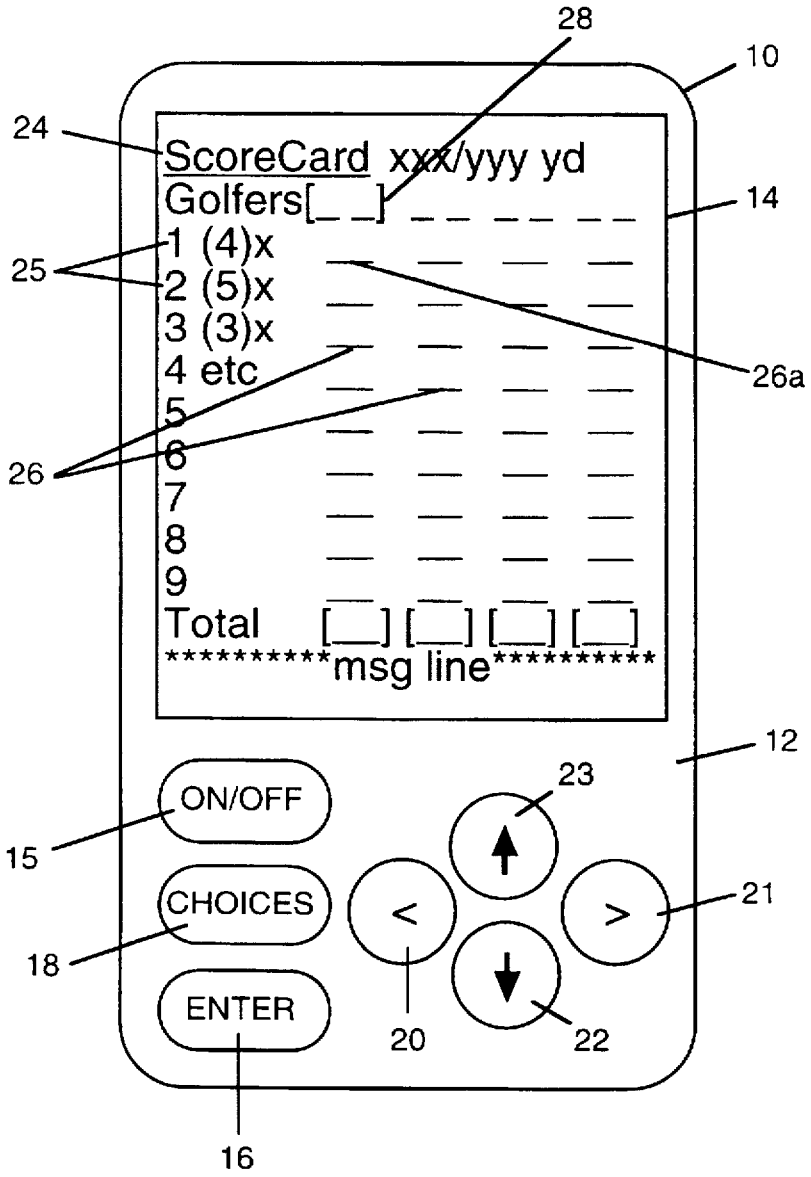
FIG. 1 is an illustrated embodiment of a handheld computer unit according to the present invention.

Referring now to FIG. 1, a handheld, computerized golf-recording and reporting unit according to the present invention is shown at 10, sized to comfortably fit in the hand. Handheld unit 10 comprises a body 12, a general output LCD display 14 comprising a substantial portion of the face of the unit, an on/off button 15, an enter button 16, a choices key 18, tab keys 20,21 and scroll keys 22,23.

Handheld unit 10 contains a microprocessor (not shown) with suitable temporary and permanent (non-volatile) memory, as well as algorithms for data entry, fact reporting, expert advice and statistical analysis in a manner hereinafter described. Microprocessors suitable for use in a unit of handheld size are commercially available, and selection of a particular type can be left to the discretion of those skilled in the art.

The general output display 14 is suitable for display of data in any format within the limits of the microprocessor. In FIG. 1, a sample "screen" on display 14 includes a screen title 24, in this instance identifying it as a "scorecard" screen. A number of data input fields 26 are identified by indicia 25 on the scorecard; e.g., in FIG. 1 the field identified by numeral 26*a* corresponds to a space for recording the score of a first golfer on hole 1. Field selection cursor 28 is used to select and identify a field in which data is to be selected or modified by the user in a manner described below. The field select cursor 28 can be moved to all non-protected fields 26 on the screen on display 14 by pressing the tab keys in the manner described below.

The unit is turned on and off with on/off key 15. Once activated, the user can selectively retrieve various screens from the memory using either the enter key 16 or choices key 18. Use of either of these keys in effect rewrites display 14 to show a different screen having a different purpose.

Tab keys 20,21 move the cursor key 28 along the rows of fields 26 from left to right or right to left depending upon the key pressed. When the screen first appears on the display, cursor 28 will appear in the upper leftmost non-protected field 26 on the screen, and can be subsequently tabbed with key 21 from left to right, top to bottom, all the way to the lowermost righthand field 26. Tab key 20 oppositely moves the cursor 28 from right to left, bottom to top. In this manner the operator can tab through fields 26 from left to right, top to bottom, and vice versa using only the two keys 20,21.

After a particular field 26 has been selected with tab keys 20,21 (by placing the cursor 28 on the field), a predetermined set of values associated with that field can be scrolled through and selected using scroll keys 22,23. Keys 22,23 scroll up and down through the range of available values for a particular field 26 until the desired value is reached. At that time, the user tabs to the next field using tab keys 20,21 leaving the earlier selected value in place. In this manner each field 26 on the screen can be given a value for storage in the memory of unit 10. Values selected in a particular field can be modified or erased by returning to that field and using the scroll keys 22,23 to choose a new value.

Accordingly, an entire screen can be filled in with golf information corresponding to the game being played merely by operating keys 20,21 and 22,23. There is no need for an entire set of numeric or alphanumeric character keys.

When a screen has been filled in as desired, pressing the enter key 16 to move to another screen automatically stores the data in the memory in association with that screen. Alternately, it will be apparent to those skilled in the art that data entry in any given screen may be conducted automatically, rather than manually. For example, automated input means such as an internal clock could be employed to provide time of day information, while an internal thermometer and/or barometer could automatically input temperature, altitude, and barometric pressure. Similarly, wind speed data might be automatically entered using a wind speed sensor. Such input means could further be linked to a microprocessor including an algorithm for extrapolating weather condition reporting screens from temperature, wind speed, and barometric pressure data. The operator can then return and view those values.

Referring now to FIG. 2, a flow diagram shows the screen selection sequence and methodology for recording and reporting golf information, and for providing comprehensive feedback and advice in real time, according to the present invention. Step 30 is simply the on/off activation of hand-held unit 10 effected with on/off key 14. When the unit is turned on, a first menu is displayed at step 32 prompting the user to choose between a game-recording mode of operation 34 or a statistics-reporting mode of operation 58. Game recording module 34 contains all of the screens and associated algorithms and data necessary to permit pre-game and game-interactive recording of information by the golfer, contained in a pre-game module 35 and game-interactive module 37. The statistics reporting module 58 uses the pre-game and game information previously recorded in module 34 to develop and selectively display a number of statistics reports.

Still referring to FIG. 2, if game-recording module 34 is selected, a game setup data screen appears at step 36 for setting parameters for the game about to be played. Pre-game screen parameters can include player identification data, data pertaining to the game to be played (e.g., number of holes, etc., and preferably data pertaining to extrinsic factors affecting performance, such as time of day, temperature, weather conditions, ground conditions, ball compression and model data, and the like. This information is entered using the tab keys 20,21 and scroll keys 22,23 described above in reference to FIG. 1. When the pre-game data screen has been filled in to the golfer's satisfaction, pressing the enter key 16 takes the golfer to an additional pre-game course data screen 38 to enter parameters identifying the course to be played; e.g., par and total yardage for each hole.

It will be understood that the number and form of the pre-game screens in pre-game portion 35 of game-recording module 34 can vary according to the desires of the programmer. For example, the pre-game setup and course data screens 36,38 could be combined into a single screen, space permitting on display 14. Or, additional pre-game screens could be provided.

At step 36 the golfer is also asked to select one of several game-interactive modes or screens from the game-interactive portion 37 of module 34. In the illustrated embodiment of FIG. 2 these include score track mode, comprising a scorecard data screen 44; easy track mode comprising scorecard screen 44, easy track screen 46 and putt entry screen 50; and detail track mode comprising scorecard screen 44, detail track screen 48 and putt entry screen 50. These three game-interactive modes represent three levels of detail for golf information recording.

As shown in FIG. 2, selection of the lowest-detail game-interactive mode, score track 44, automatically takes the user from the pre-game module 35 directly to step 44. The user is then limited to the scorecard screen 44 for the remainder of the game.

Selection of the next-highest level of game-interactive detail, easy track mode 44,46,50 transfers the golfer to one additional pre-game information recording screen in FIG. 2, golf set data screen 40. When golf set data screen 40 has been filled out, pressing enter key 16 initially passes control to scorecard screen 44. Having selected easy track mode, the golfer can transfer back and forth between scorecard 44, easy track screen 46 and putt entry screen 50 by further actuation of the enter key 16.

If the golfer selects the highest level of detail, detail track mode 44,48,50, the golfer is presented with two additional pre-game data screens after step 38 including golf set data 40 and golf ball data 42. When these have been completed in the manner described above, the golfer is then transferred to the detail track mode in which the golfer moves between the scorecard data 44, detail track screen 46 and putt entry screen 50 with the enter key. As with the other game-interactive modes, control is initially passed to scorecard screen 44 once the pre-game screens have been completed, after which the other screens (if any) in that mode can be accessed.

Also included in the golf recording module 34 in FIG. 2 are a number of randomly-accessed, game-interactive advice/feedback modes: "game play facts" mode 53,54, "game play advice" mode 51,52, and "game play statistics" mode 55,56,57. By using the "choices" key 18 on unit 10, these three advice/feedback modes can be randomly accessed from certain of the game-interactive screens, in this illustrated embodiment from scorecard mode 44, easy track mode 44,46,50 and detail track mode 44,48,50.

When the scorecard data screen 44 has been completely filled out in any of the game-interactive modes, pressing enter key 16 on unit 10 automatically switches to the end of game screen 49. The end of game screen 49 is also preferably one of the choices available with the choice key 18 from any of the game-interactive screens 44,46,48 at any time during the game, permitting the golfer to close out and record a game early.

Still in FIG. 2, if at menu 32 the golfer chooses the statistics module 58, pressing enter key 16 passes control to a statistics reports menu at 60 listing a variety of reports addressing various aspects of the golf game. The statistics reports are compiled from the information entered in game-recording module 34, and can for example show performance in various areas for the last one hundred games (or any suitable timeframe, limited only by the memory capacity of the microprocessor in unit 10). These may be values averaged over the last hundred games, or separate reports for each game, again as desired by the programmer.

At step 60 the golfer is given the option of passing control to selection criteria screen 62 to limit the timeframe over which the statistics in the selected reports are to be averaged or otherwise listed. In the illustrated embodiment, this can be done over a range of calendar dates, or specific dates or games can be selected.

With the selection criteria at screen 62 entered, or if screen 62 is bypassed from screen 60, the appropriate report is displayed on the screen at step 64.

It will be apparent to those skilled in the art that the above flow diagram and general description of screen sequence and content is variable depending on the desire of the programmer and the sport for which the unit is tailored. Any of the "screens" can be a single screen or a series of consecutively-displayable screens if the report requested at that step contains too many lines to be displayed in its entirety on display 14. This depends on the size of display 14 (preferably of handheld size) and the number of lines contained in a screen.

The particular order of screen selection, and the number and type of available screens in the various pregame, game-interactive and statistics reporting modes can vary. FIG. 2 is merely the illustration of a preferred embodiment of the invention adapted to the game of golf.

Figure 3:
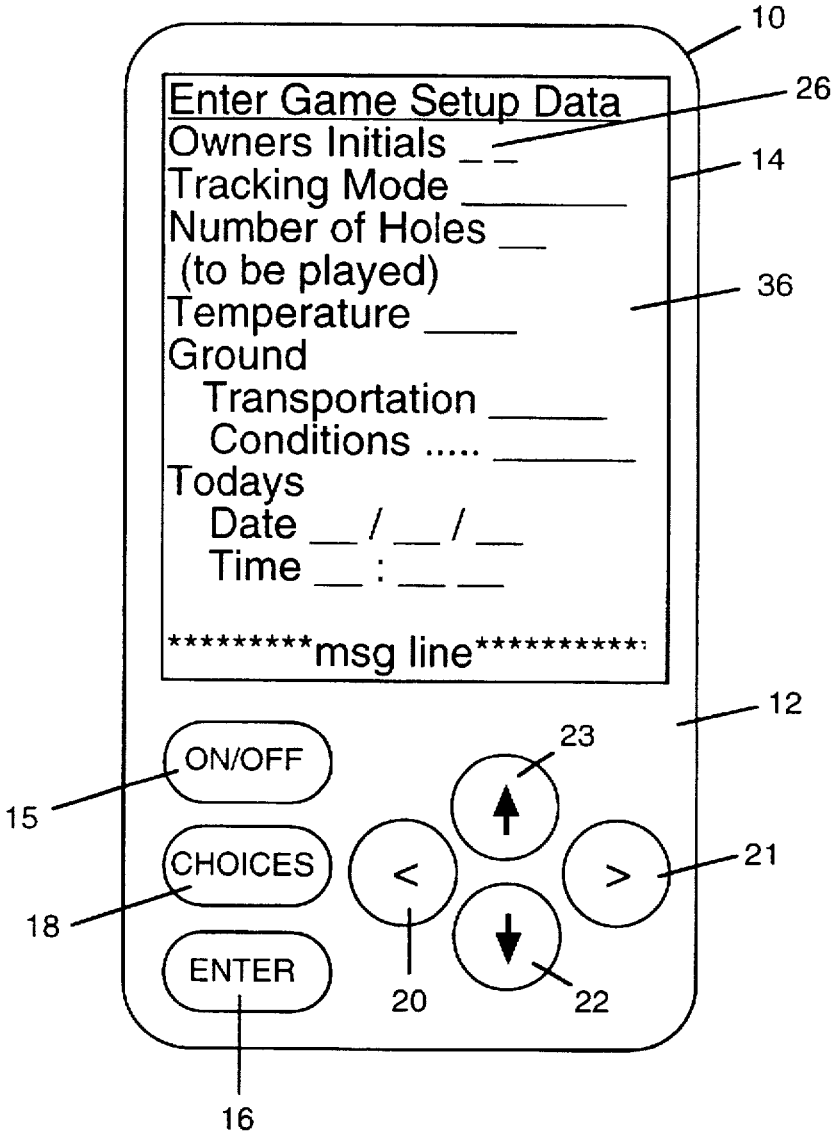
FIG. 3 is one embodiment of a game setup data screen displayed in accordance with the methodology of FIG. 2 on the display of the unit in FIG. 1.

Referring now to FIG. 3, an illustrated embodiment of a game setup data screen 36 is shown as it appears on display 14. Information such as owner's initials, number of holes to be played, temperature an extrinsic factors such as, type of ground transportation to be used in the game, ground conditions date and time are entered by the operator using the tab keys 20,21 and the scroll keys 22,23 in the manner described above. For example, the two data input fields 26 associated with "owner's initials" are each supplied with a full range of alphabetical values which can be selected by the golfer using scroll keys 22,23. When the "owner's initials" have been filled in, the player then proceeds to the next field and enters the required information to set the parameters of the upcoming game.

It should be noted in FIG. 3 that a "tracking model" field 26 is provided. It is here that the golfer, using the scroll keys 22,23, can select one of the game-interactive modes, shown in FIG. 2 and described in detail below.

Figure 4:
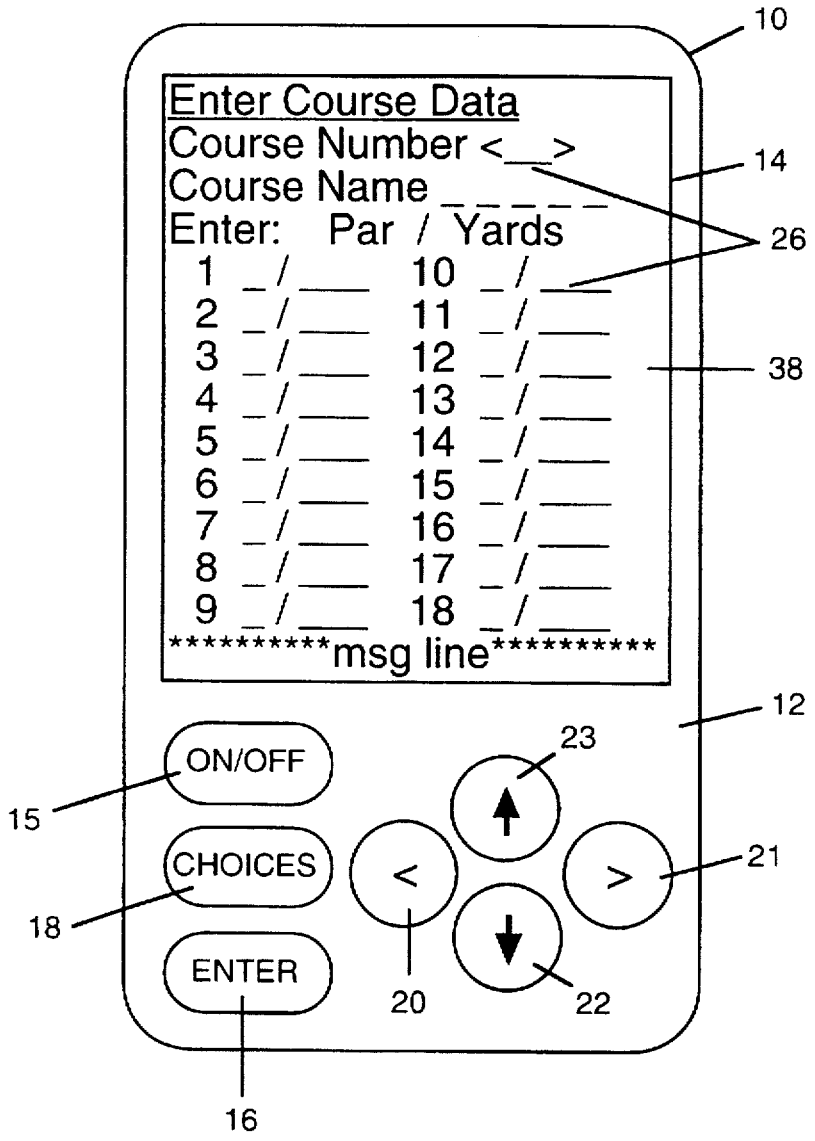
FIG. 4 is one embodiment of a course data screen in the pre-game mode of FIG. 2.

When the golfer has filled in the game setup data screen, pressing the enter key 16 on the handheld unit 10 will store the data just entered and pass control to the next screen in the sequence, the course data screen 38 shown in FIGS. 2 and 4.

In the course data screen 38 of FIG. 4, the same system and method for selection/entry of additional game parameters is used to fill out the screen. Tab keys 20,21 are used to move the cursor 28 among the various data input fields 26 corresponding to the holes on the course. Screen 38 has a "course number" field and associated "course name" field. The parameters for a number of different golf courses can be stored in the memory using screen 38, in the illustrated embodiment up to a maximum of ten courses. The parameters for each course are then identified or labelled with a course name and number. Subsequent scrolling through the "course number" field with scroll keys 22,23 retrieves and displays the corresponding, previously-recorded course parameters of "par" and "yards" for all holes of that course. Once this information has been stored via the enter key 16, it remains in the microprocessor memory and can be recalled until replaced. The scroll keys 22,23 are then used to select among a predetermined set of values to fill in the "par" and "yards" fields for each of holes 1 through 18.

To keep the data entry simple and efficient, the "par" values for the holes are set between 3 and 6, and the "yards" value for each hole begins at a low default value, for example 100 yards, and can be increased or decreased in 5- or 10-yard increments. In a preferred mode, a specific "yards" default value is displayed immediately after a "par" value is entered by the user for a hole; e.g., 150 yards for par 3, 300 for par 4, 450 yards for par 5, 600 yards for par 6.

When the course data screen 38 has been completed (or, in the case of a previously-recorded course selected using scroll keys 22,23 to scroll through the "course number" field in 38), pressing enter key 16 passes control to a new screen depending upon the game-interactive mode selected in the "tracking mode" field of FIG. 3.

Figure 7A:
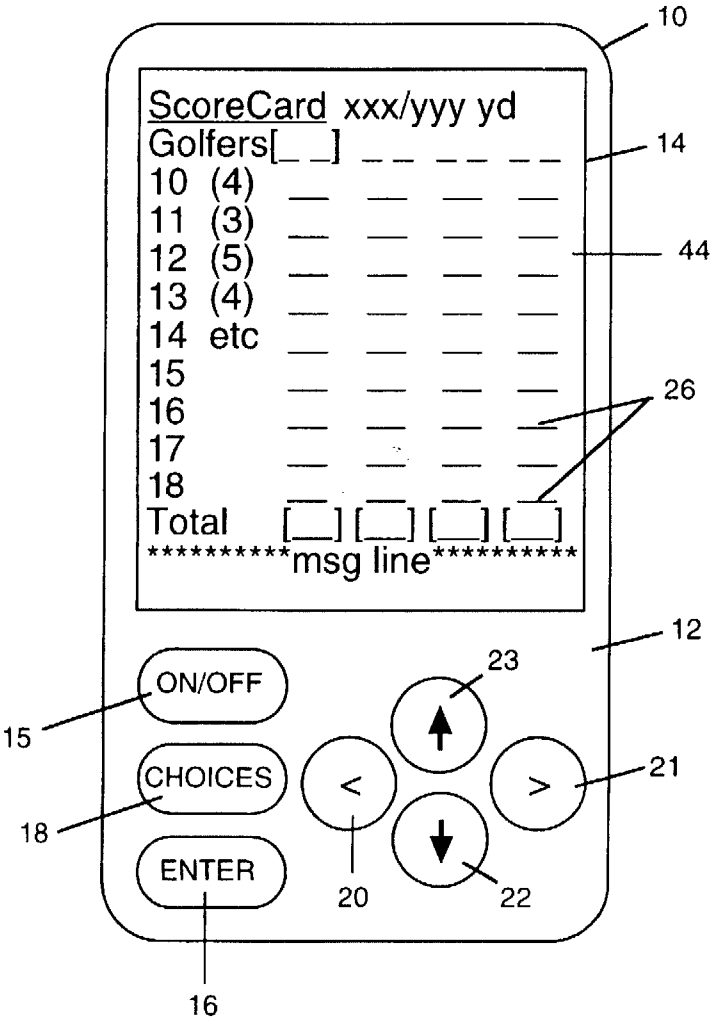
FIGS. 7 and 7*a* are one embodiment of a score card screen in a game-interactive mode according to FIG. 2.
Figure 7:
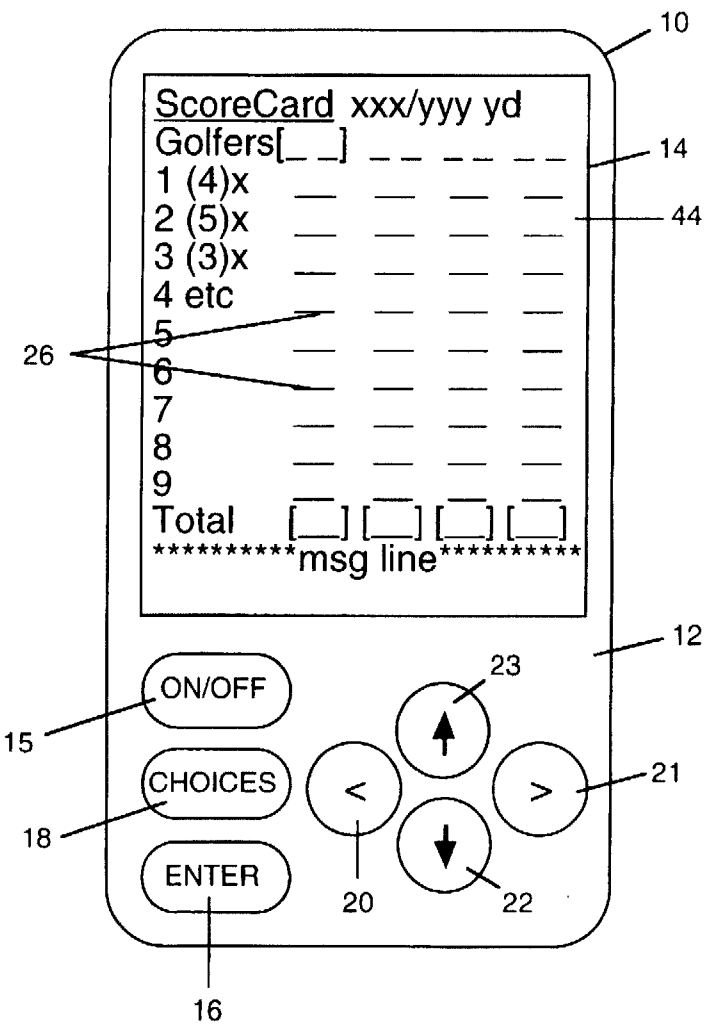

If the "score track" tracking mode was selected, control is automatically passed to the "scorecard" screen 44 as shown in FIG. 7 on display 14.

Figure 5:
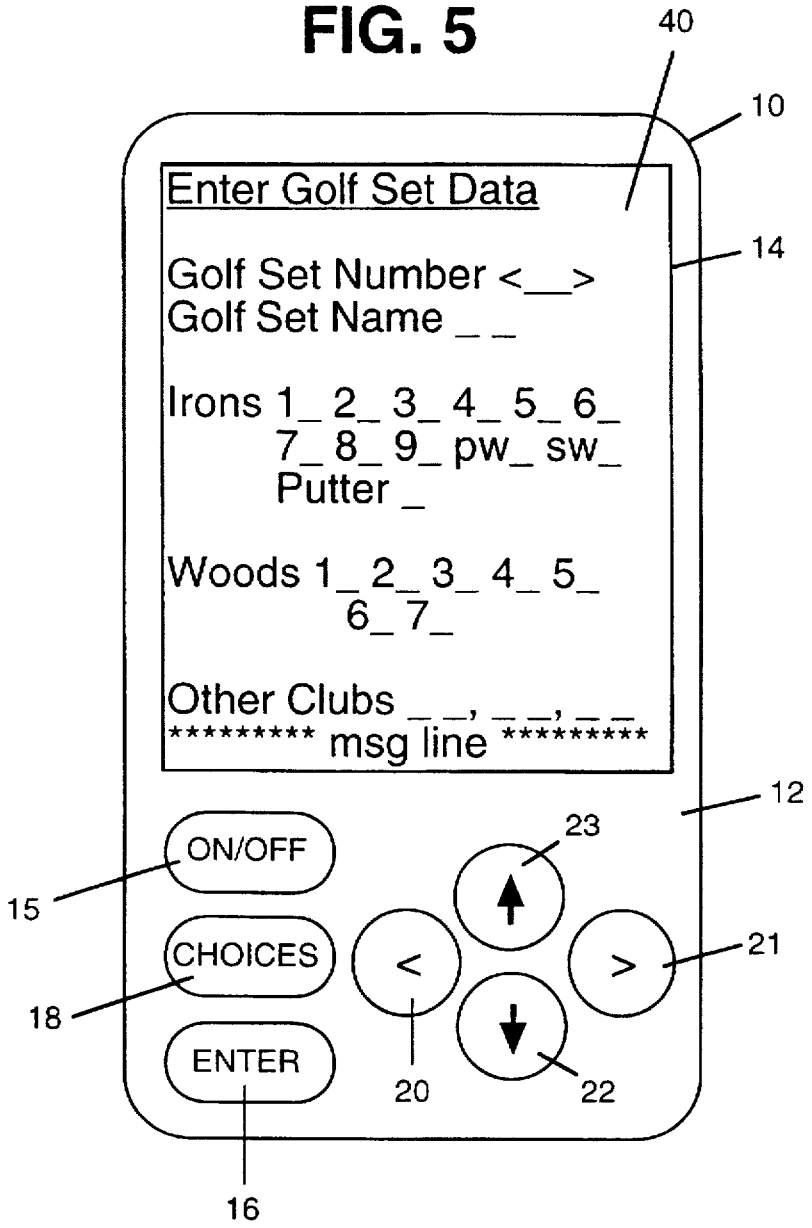
FIG. 5 is one embodiment of a golf set data screen in a pre-game mode according to FIG. 2.
Figure 18:
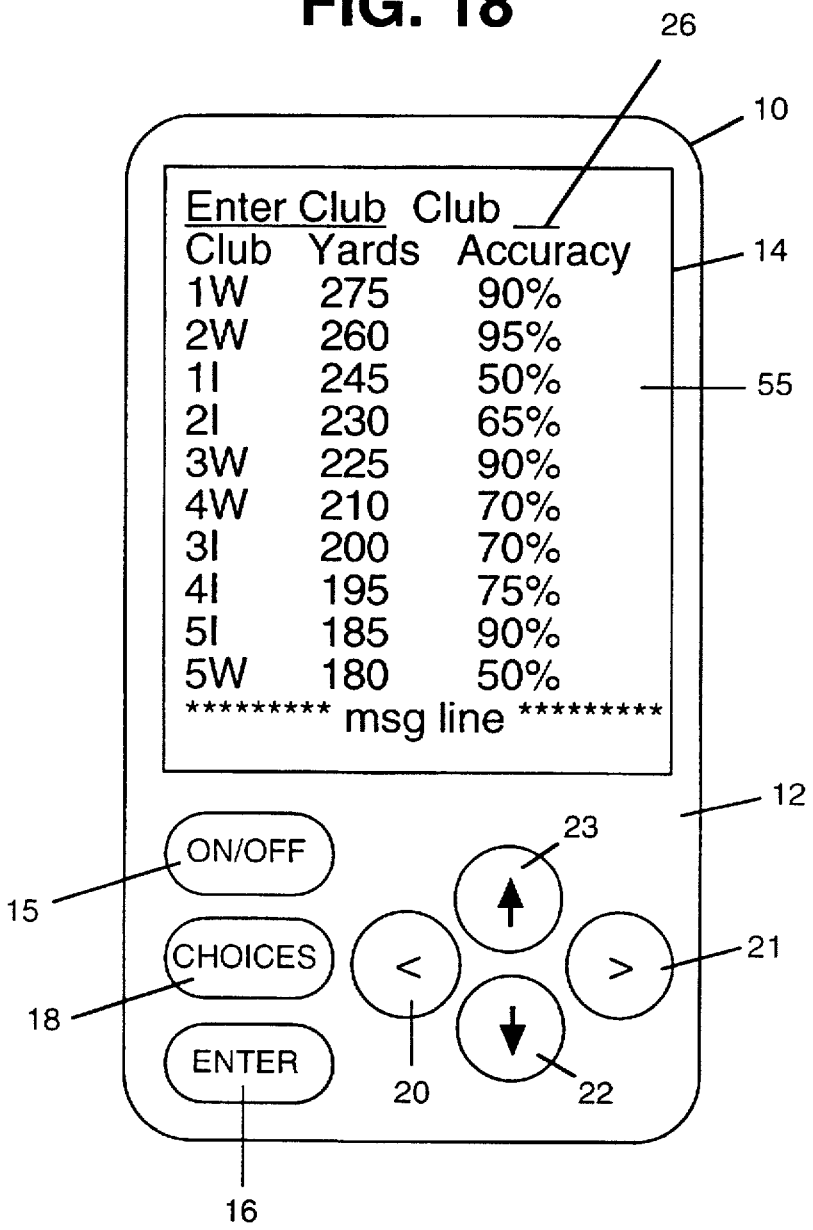
FIGS. 18 to 20 are screens of a game-interactive statistics module.
Figure 20:
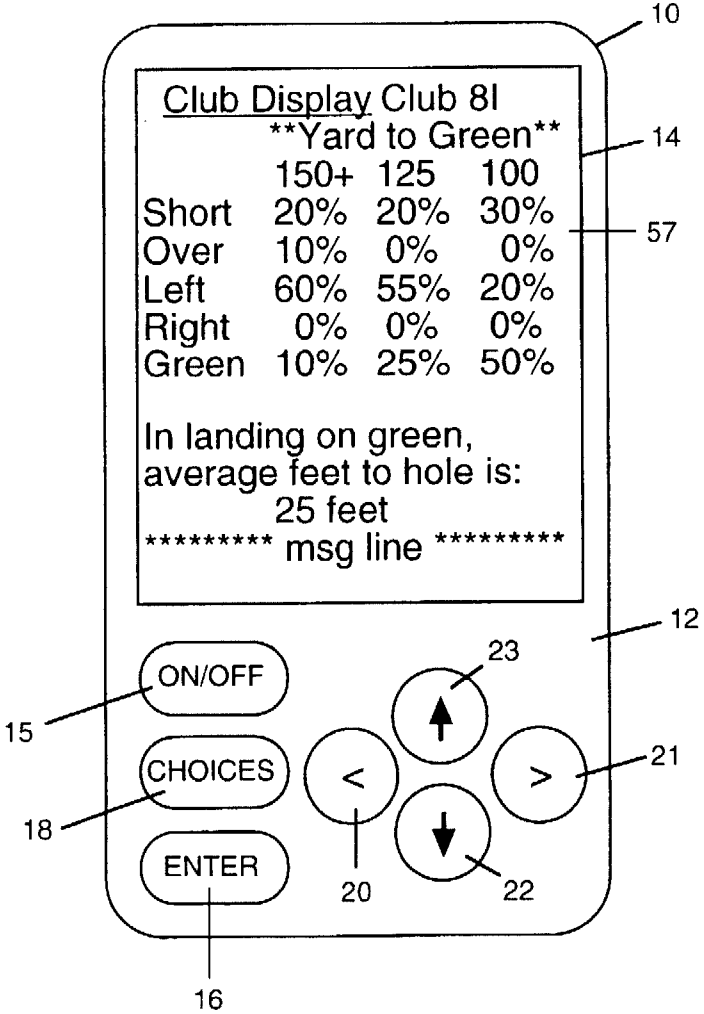
Figure 19:
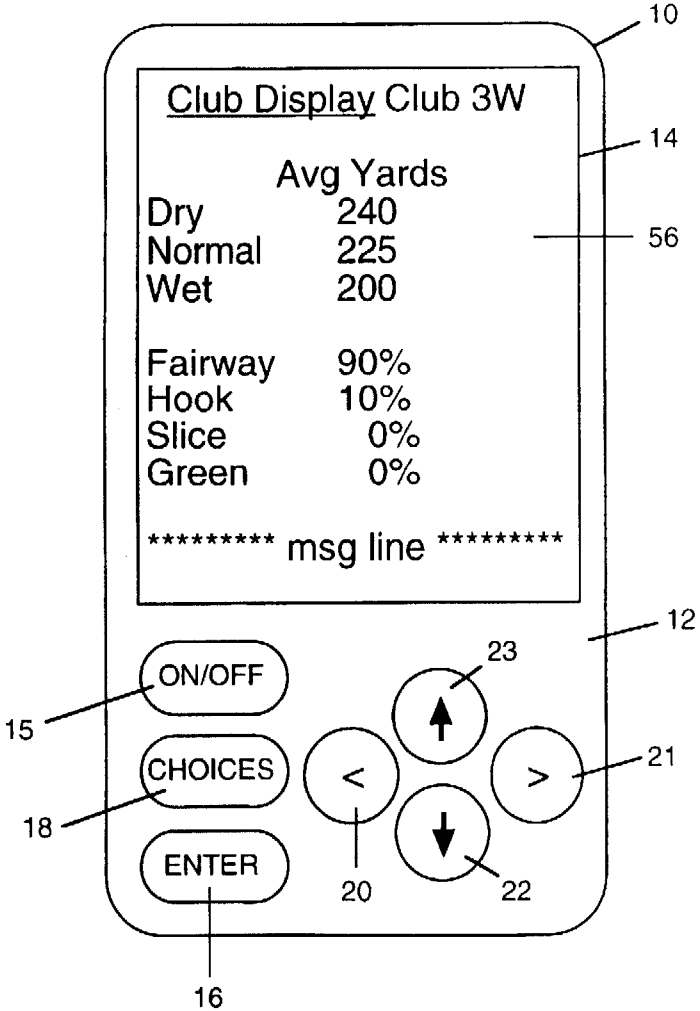
Figure 32:
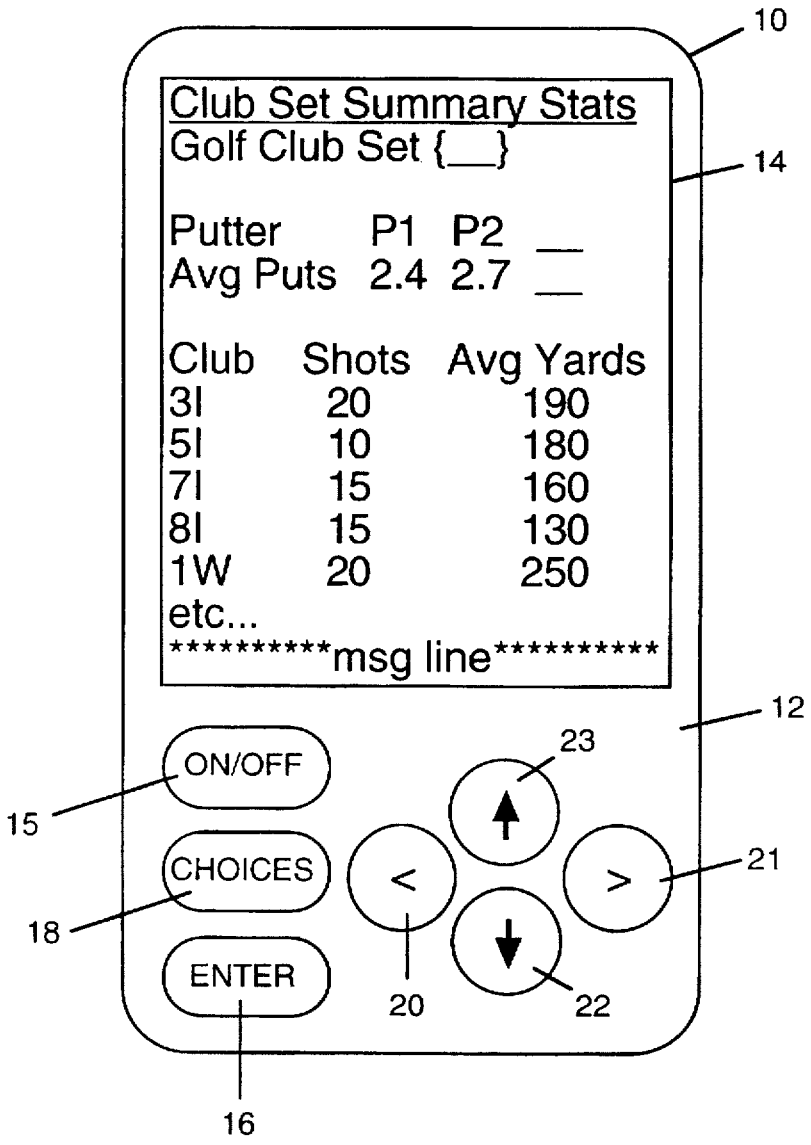

If the "easy track" mode was chosen, the unit remains in pre-game mode and control is passed to the "enter golf set data" screen 40 of FIG. 5. The golf-set data entered in this screen can be employed as a basis for game-interactive golf club selection advice, as well as post-game performance reports. Such reports can provide a player with an indication of where his game is better or worse with respect to a particular club. For example, player performance information relating to accuracy and distance achieved with a particular club can be compiled for statistics/reports useful for game-interactive club selection advice (FIGS. 18–20). Since differences between given sets of golf clubs may be considered an extrinsic factor tending to affect a players' performance, statistics reporting screens can be provided comparing a player's average yardage results with different sets of golf clubs (FIG. 32). When pre-game screen 40 is filled in and entered, the unit shifts to game-interactive easy track mode 44,46,50.

In the game-interactive modes, control is always initially passed to the scorecard screen 44, from which the other screens in that mode can be accessed.

Figure 6:
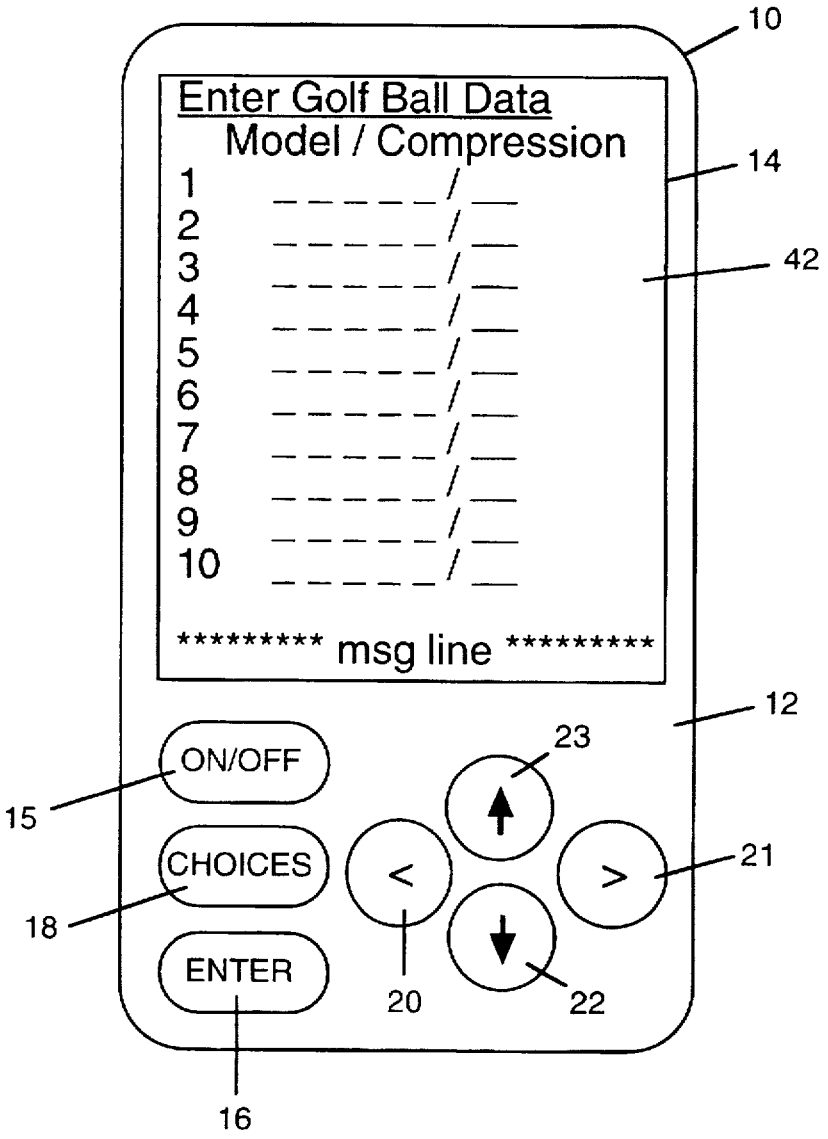
FIG. 6 is one embodiment of a golf ball data screen in a pre-game mode according to FIG. 2.
Figure 24:
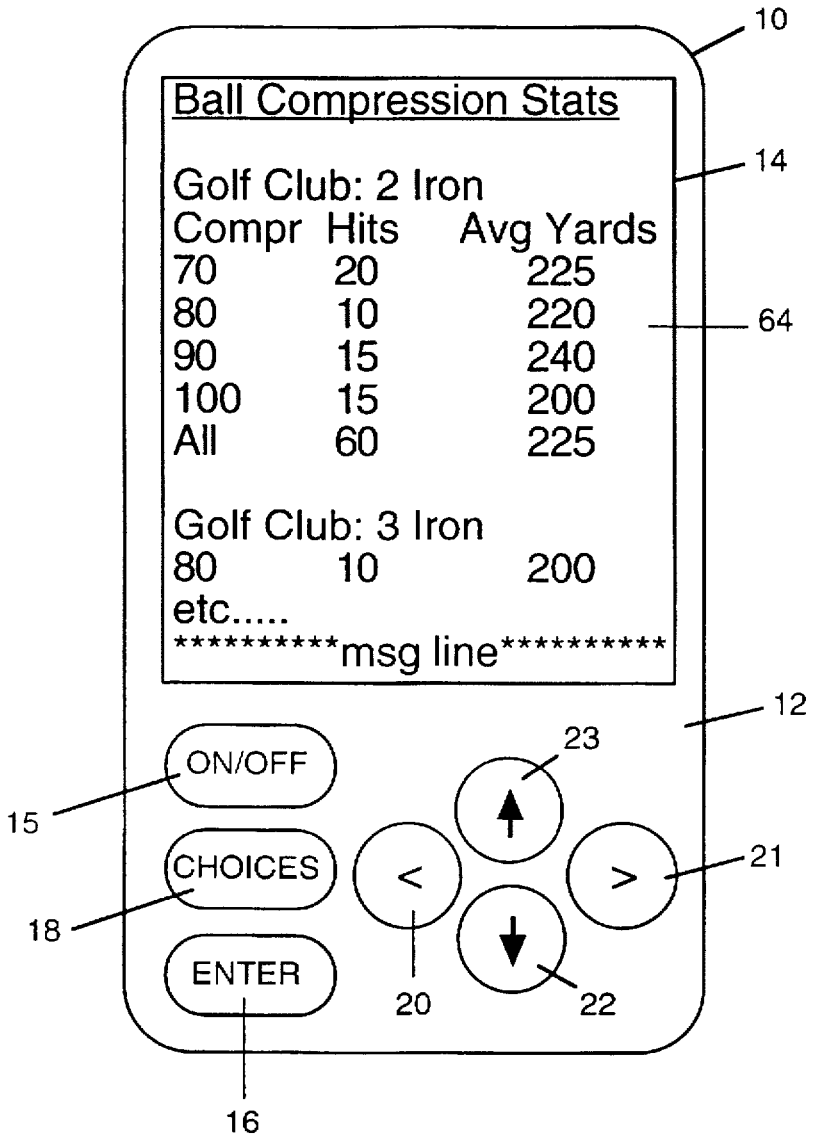
FIGS. 24 to 41 are illustrative embodiments of statistics report screens in the statistics mode of FIG. 2.
Figure 25:
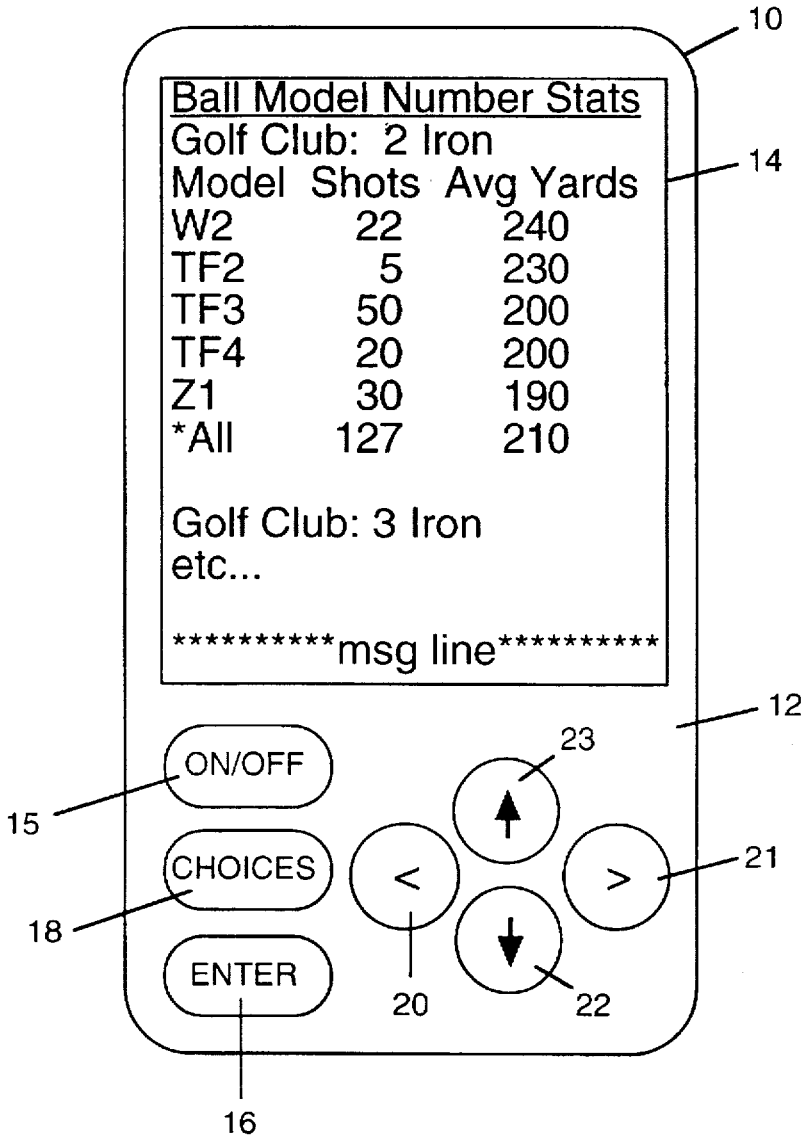
Figure 26:
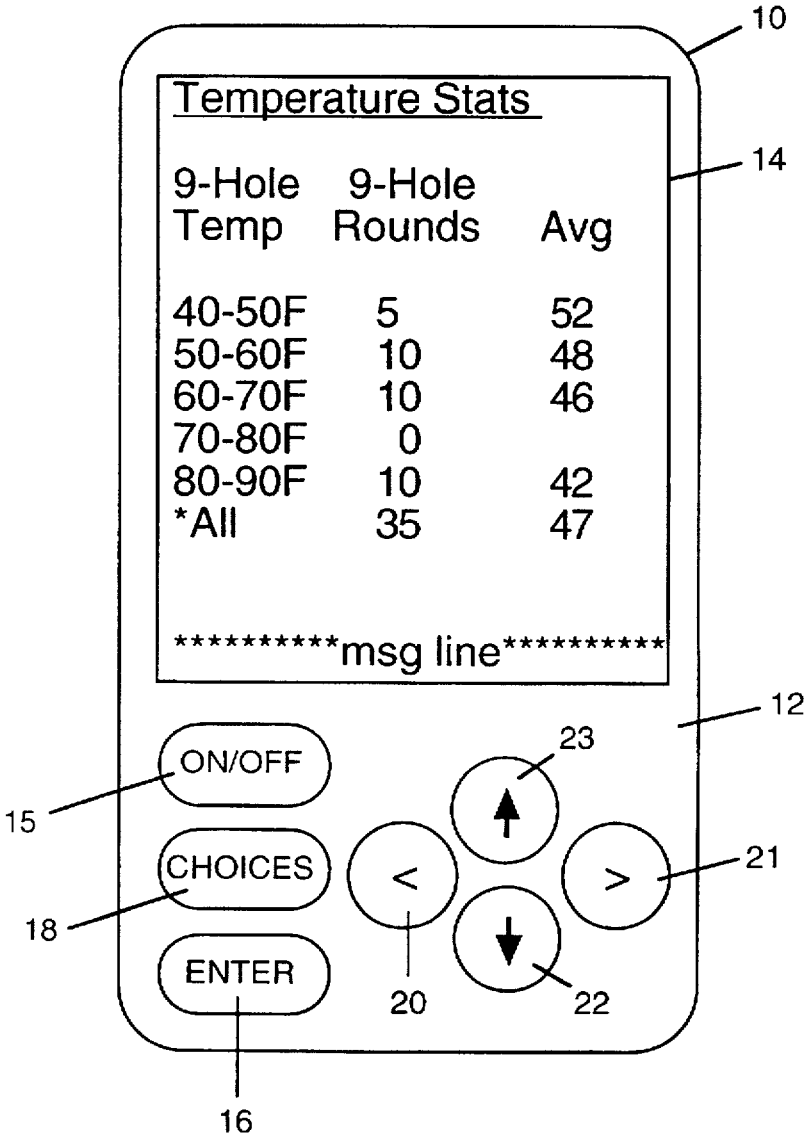
Figure 27:
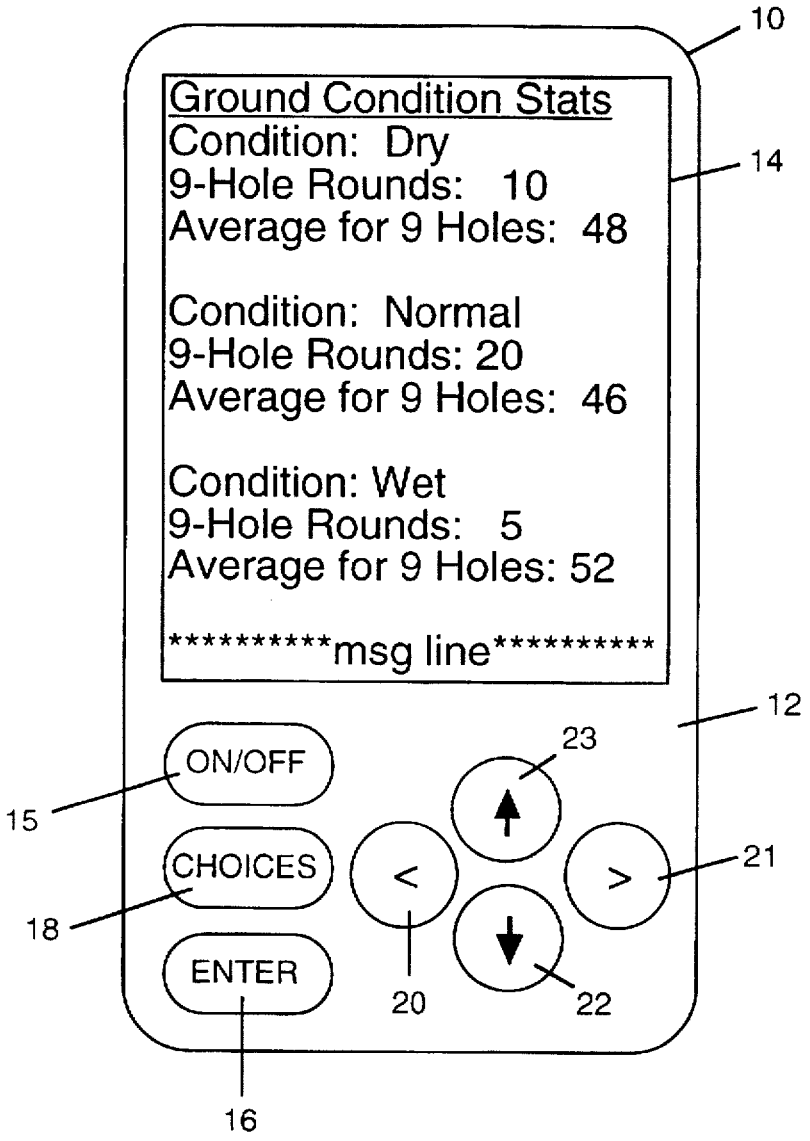

If the detail track mode 44,48,50 is chosen at "tracking mode" in FIG. 3, then both the golf set data screen 40 of FIG. 5 and the golf ball data screen 42 of FIG. 6 appear in succession to be filled out and entered prior to actually entering the game-interactive detail track mode. As with the club set data entered in the golf set data screen 40, the extrinsic factors of golf ball model/compression data entered in screen 42 provide the basis for post-game and/or game-interactive advice and statistical screens tending to aid a player in both club selection and general improvement of his golf game. As the model/compression of a particular golf ball can be considered an extrinsic factor affecting performance, statistical reports of yardage in relation to the clubs used and the compression/model data (FIGS. 24, 25) can have positive results on future performance. Likewise, golf club selection advice based on ball compression/model data is also provided according to the method described below. Again, control initially passes to scorecard screen 44, from which screens 48,50 can be accessed.

The number and content of the pre-game screens for each game-interactive mode is dependent on the parameters and performance and extrinsic factor data needed for the level of reporting detail in the associated game-interactive mode. For example, the illustrated embodiment contemplates entry of a number of parameters, including course data defining the scope of the game to be played (e.g., the number of holes and the type and number of clubs to be used). In addition, selected extrinsic factors are recorded and reported in relation to performance to help improve player performance through club selected and game-interactive and post-game reports. As discussed, examples of such extrinsic data include temperature, time of day, barometric pressure, weather, ground and fairway conditions, golf gall model and compression data, and the club set being used.

Referring now to FIG. 7, the lowest-detail score track mode comprises "scorecard" data entry screen 44, in FIG. 7 limited to the front nine holes of the course. Again, the tab keys 20,21 are used to tab back and forth among the various fields 26 to enter information such as the "golfers" initials and the score achieved by each golfer for each of the first nine holes. In the preferred embodiment the first "golfers" field 26 is automatically filled in with the owner's initials, entered in the game setup data screen 36, and is non-alterable. This helps safeguard the unit from theft by providing a permanent "name tag" identifying the owner.

Figure 10A:
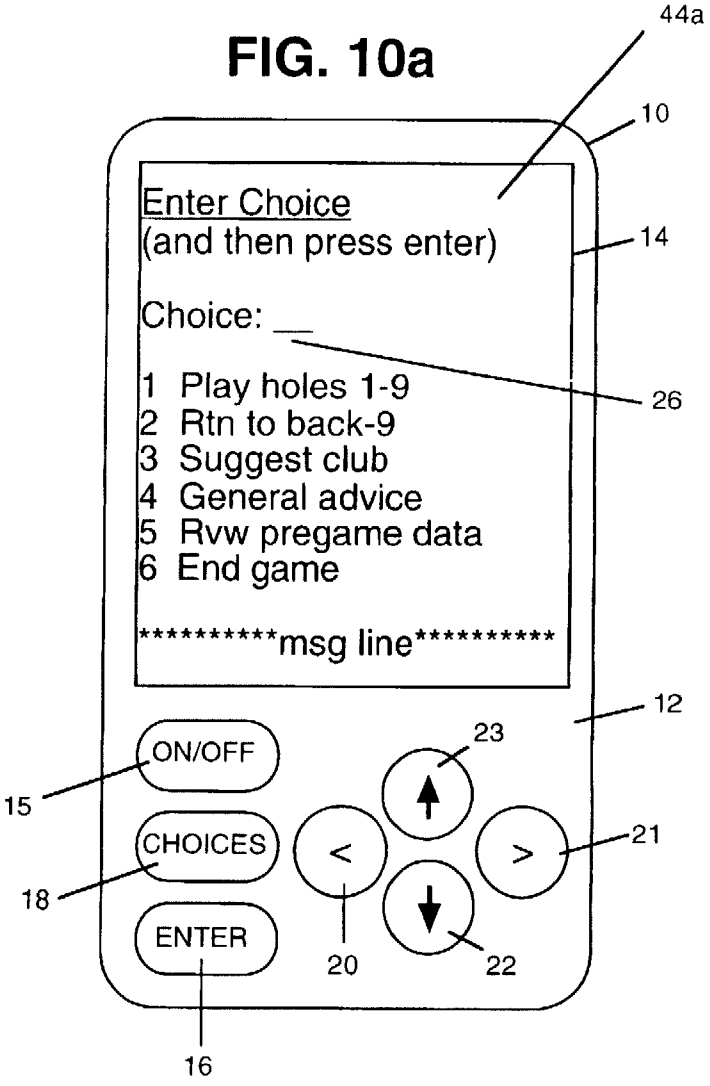
FIGS. 10 and 10*a* are choices menus associated with one of the game-interactive screens according to FIG. 2.
Figure 10:
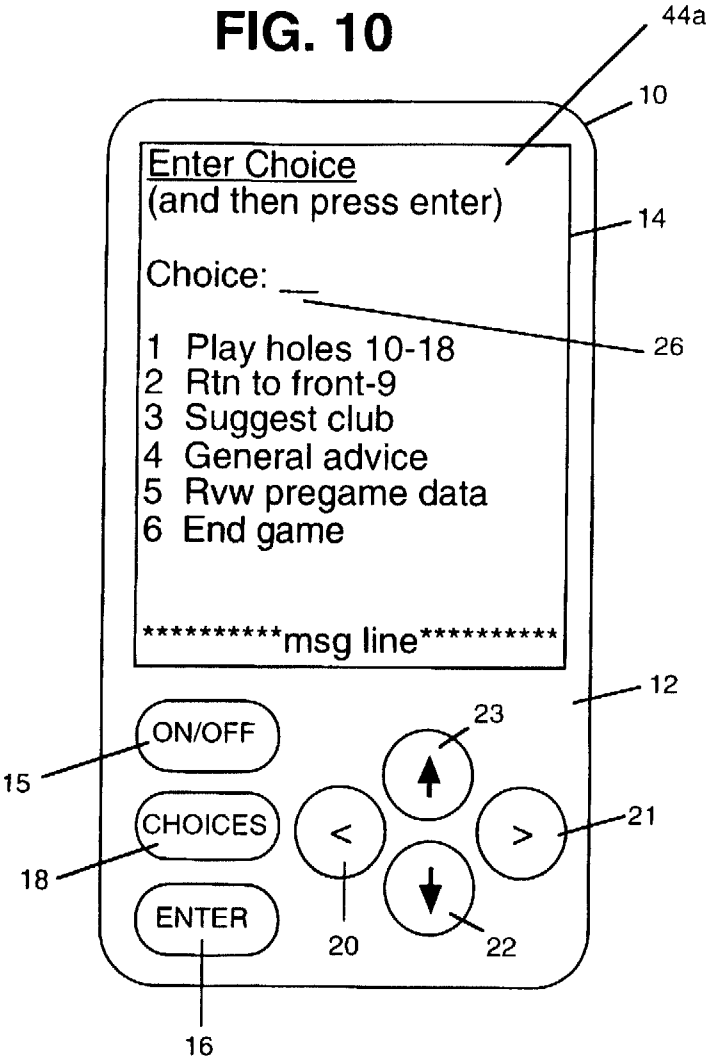

If the "score track" mode is chosen in step 36, then the golfer is limited to that game-interactive mode for the rest of the game. However, operation of the choices key 18 passes control to a "choices" menu or menus 44*a* as shown in FIGS. 10 and 10*a*. Referring to FIG. 10, the scorecard choices menu 44*a* lists five ways to exit the "scorecard" screen 44 of FIG. 7, one of the five options selected using scroll keys 22,23 in the single "choice" field 26 provided, and then pressing enter key 16. The options listed in FIG. 10 are not comprehensive, but are an illustrative embodiment listing logical courses of action or alternative screens accessible from the score track mode of reporting.

In the illustrated embodiment every pre-game and game-interactive screen is provided with a "choices" menu similar to that of FIG. 10. The number and type of choices available for each screen varies depending on the context of the screen with which they are associated, but the format and operation is generally similar to that of FIG. 10. The choices menus for other screens are not shown in the illustrated embodiment in consideration of their similarity and the amount of space needed to illustrate all of them. Those skilled in the art will be able to readily adapt the choices menu 44*a* of FIG. 10 to the other screens.

Scorecard screen 44 will typically comprise two screens, one for holes 1–9 (FIG. 7) and one for holes 10–18 (FIG. 7*a*). This is determined at the "number of holes to be played" field in game setup data screen 36 of FIG. 3. The choices menu associated with scorecard screen 44 contains a choice to permit switching back and forth between the scorecard screens for the front and back nines as the game demands.

When the scorecard screen 44 of FIG. 7 has been filled in and the game is over, pressing the enter key 16 on the handheld unit 10 will store the scorecard information in the memory and pass control to an "end of game" screen 56 as shown in FIG. 2.

Figure 8:
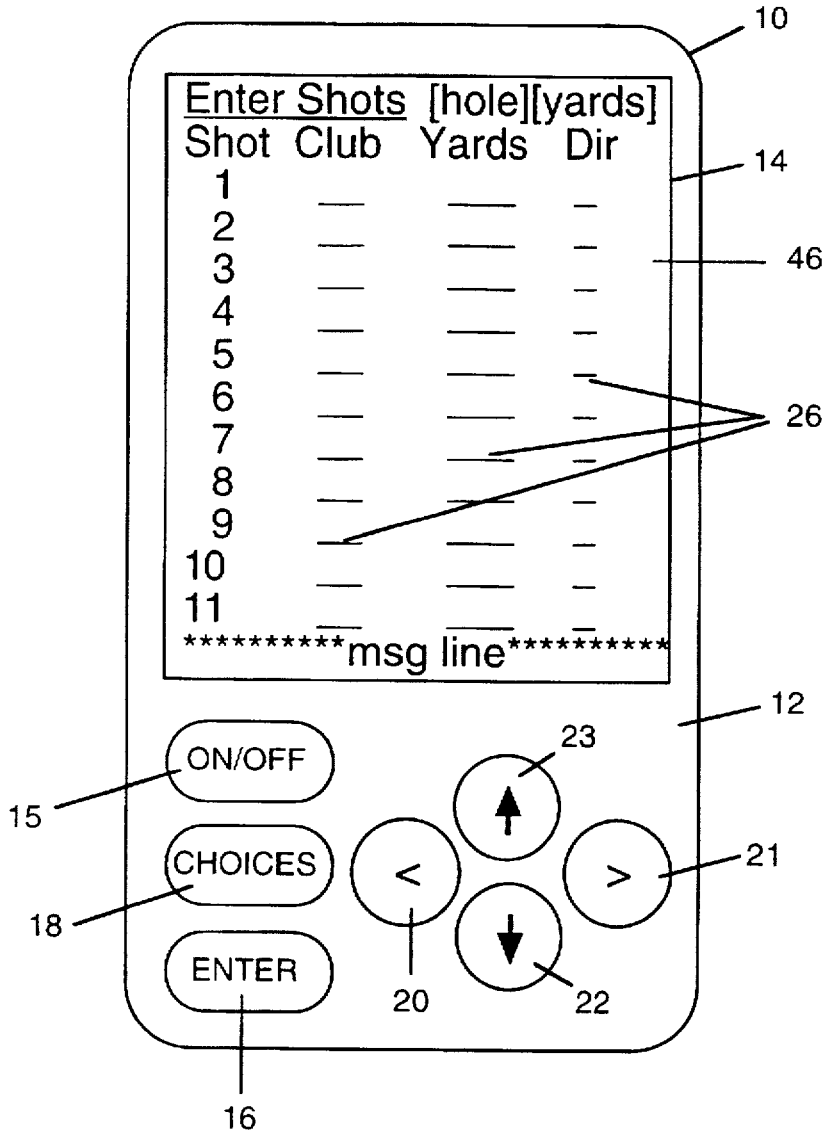
FIG. 8 is one embodiment of a low-detail screen in a game-interactive mode according to FIG. 2.

Referring now to FIG. 8, "easy track" data entry screen 46 is available from scorecard screen 44 if the easy track mode was selected. Pressing the enter key 16 will take the player back and forth between the "easy track" data entry screen 46 and the "scorecard" data entry screen 44. In the "easy track" data entry screen of FIG. 8, data for each shot of a specific hole is entered in the fields 26 corresponding to club, yards and direction information using the tab keys 20,21 and the scroll keys 22,23.

Figure 11:
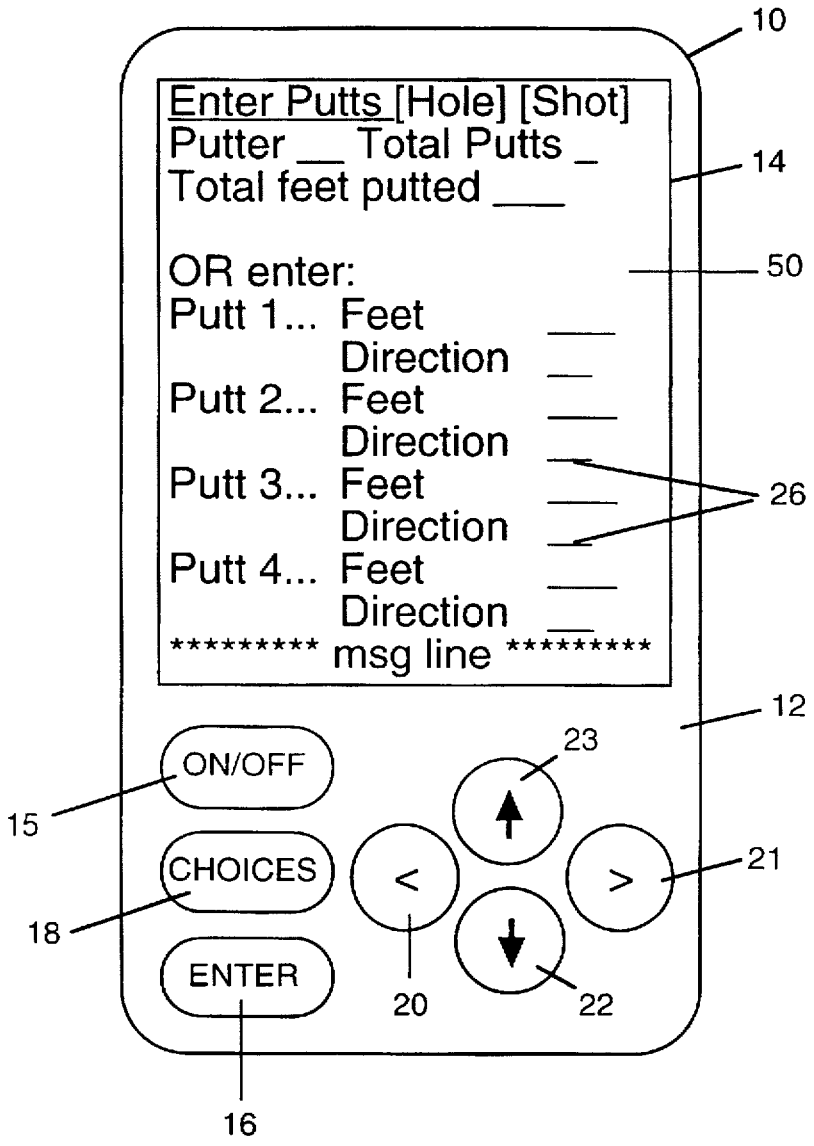
FIG. 11 is one embodiment of a putting data recording screen in a game-interactive mode according to FIG. 2.

Also available from easy track screen 46 is a putt entry screen 50 shown in FIG. 11. Control is passed automatically from screen 46 to screen 50 upon selection of the putter in the "club" field for that shot. Control is returned to scorecard screen 46 when the hole is over and enter key 16 is pressed.

The "easy track" screen of FIG. 8 can be used to record data for each shot on each hole on the course played. The "hole" and "yards" fields 26 at the top of the screen are provided with values corresponding to the current hole being played. The "yards" field is derived from the course data screen 38 previously filled in before the game. As each hole is completed, pressing the enter key 16 will store the shot information recorded for that hole in the memory and redisplay the "scorecard" screen 44 of FIG. 7.

Still referring to FIG. 8, the cursor 28 is initially located on the "club" column for shot 1, and can be moved throughout the fields on the screen as described above. A default distance (under "yards" column) can be selected, for example in the illustrated embodiment 100 yards. The increments in which values can be selected using the scroll keys 22,23 in each field under the "yards" heading are dependent on the club selected for that shot in the "club" column. Under the "direction" column the values in the illustrated embodiment are a default value of "ST" for straight, "HK" for hook, "SC" for slice, "GR" for a shot landing on the green, and "HO" for a shot into the hole.

Figure 9:
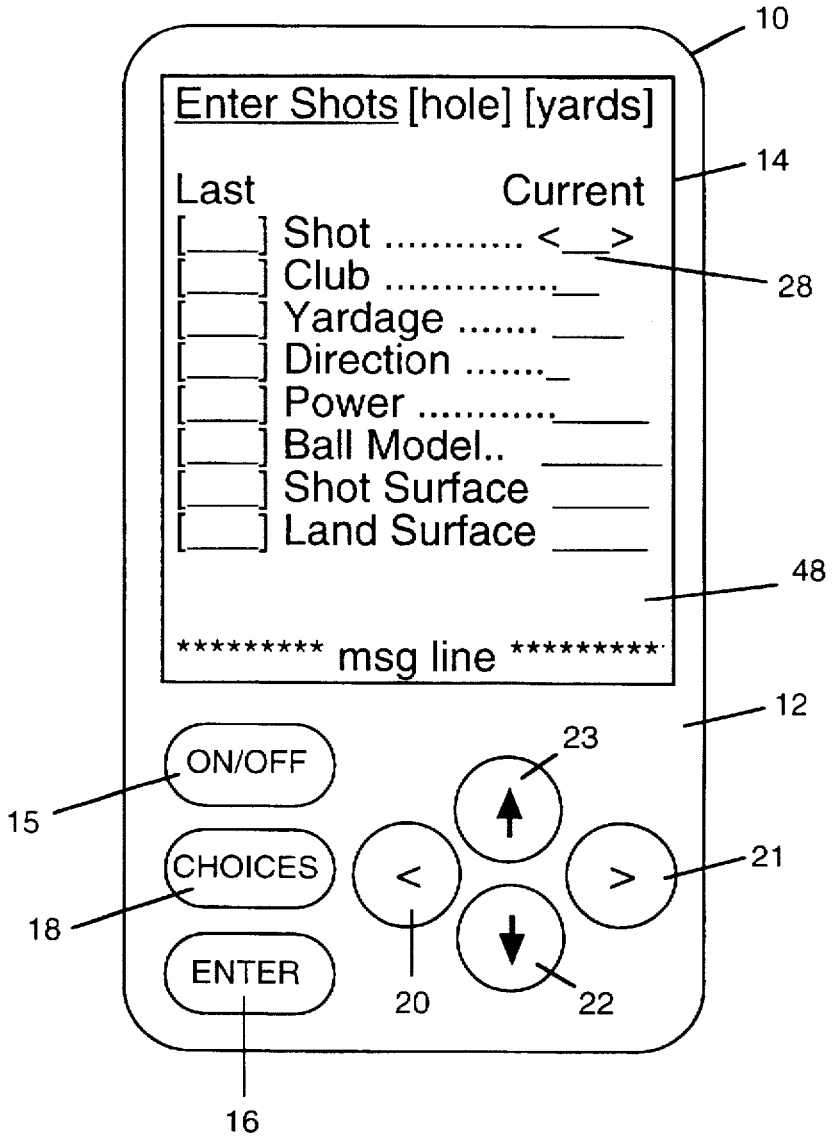
FIG. 9 is one embodiment of a high-detail screen in a game-interactive mode according to FIG. 2.

Referring now to FIG. 9, the "detail track" screen 48 is shown with more-detailed information corresponding to each shot made on each hole; e.g., in addition to shot, club and yardage information, the direction, power, ball model, shot surface and landing surface information can be recorded. Tabbing through the fields 26 for the listed parameters is done with tab keys 20,21, and the values stored for those fields selected with scroll keys 22,23. Once the club, yardage, direction, power, ball model, shot surface and landing surface values are entered for a particular shot, pressing enter key 16 will enter that information in connection with that shot in the memory, and redisplay it in the appropriate field under the column labelled "last."

Previously entered shots and the information entered and stored therewith for the current hole being played can be retrieved later by simply scrolling backwards through the "shot" field values.

Except for the "club" field, all fields in the illustrated embodiment of FIG. 9 are defaulted to predetermined values. For example, "yardage" is given a default value of 100 yards, incremented by 5, 10, or 25 yard segments depending on the club selected. The "direction" field default value is "ST" for straight; other directional choices available are described in reference to the "easy track" screen 46 in FIG. 8. The "ball model" field is defaulted to the first ball model earlier entered in the pre-game data screens. "Power" is given a default value of "full", with selectable options of 0.25, 0.50, 0.75 and default value "full." "Shot surface" is given a default value of "fairway", with selectable options including "fringe", "rough", "tee", "sand". "Landing surface" is given a default value of "fairway", along with selectable options of "rough", "sand", "green", "lost", "water", "fringe".

As shown in FIG. 2, during the golf game the player can switch from the scorecard screen 44 to the detail track screen 48 and back again by pressing enter key 16. Putt entry screen 50 is also available from the detail track shot screen 48 of FIG. 9, if the putter is selected in the "club" column as earlier described.

Like the screens before it, the detail track screen 48 of FIG. 9 is also provided with a number of choices in a choices menu screen (not shown) displayed by pressing the choices key 18 on unit 10. The "choices" menu for the detail track screen 48 in the illustrated embodiment include 1) enter next shot, 2) go to scorecard screen, 3) suggest club, 4) general golf advice, 5) end game. The default value in the choices menu for the detail track screen 48 is 1) enter next shot. The "suggest club" choice screen in the detail track mode provides appropriate club selection advice based on the data entered into the game set-up, pre-game, and game-interactive screens. For example, club set, temperature, wind, ball compression/model data, player shot performance with various clubs, and other intrinsic and extrinsic factor data entered both before and during game play will be evaluated by the microprocessor to determine the best club for a player to use. Of course, the complexity of the algorithm will vary with each game-interactive mode, according to the amount of data prompted and entered in the various pre-game and game-interactive screens.

Also included in game recording module 34 are a number of advice/feedback modules accessible by the golfer during play. In the illustrated embodiment of FIG. 2 these are the game play advice module 51,52; the game play facts module 53,54; and the game play statistics module 55,56,57.

Figure 14:
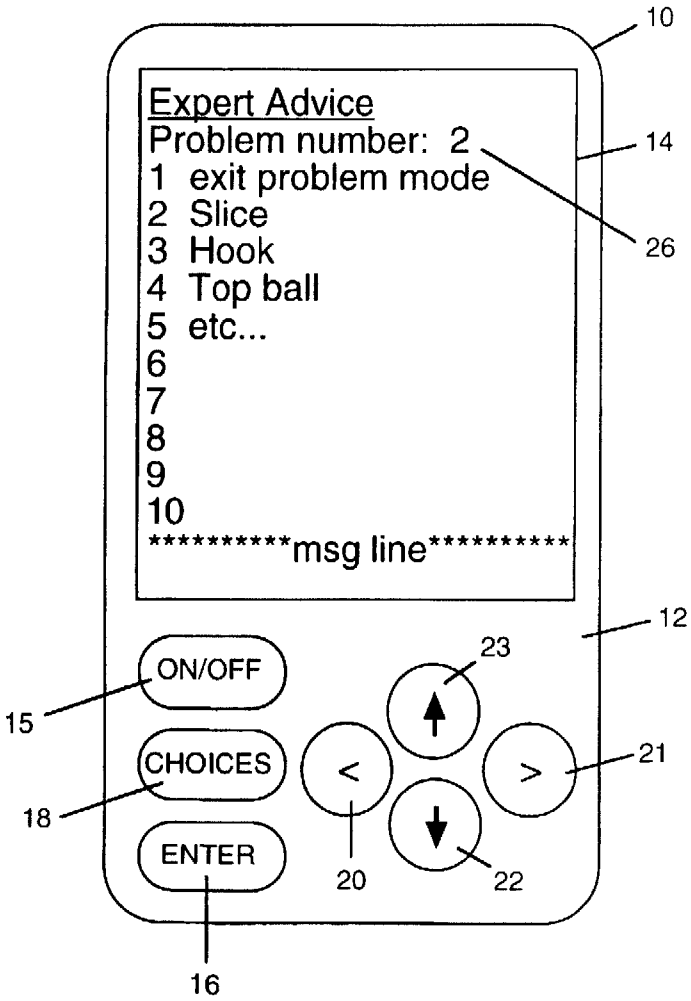

The game play advice module comprises two screens, golf problem screen 51 and problem solution 52. Selection of the game play advice module from the choices menu of the one of the game-interactive modes passes control to the golf problem screen 51 shown in FIG. 14. A single "problem number" field 26 is provided to select and enter the number of the problem for which the golf wants advice; e.g., 2) slice, 3) hook, 4) top ball, etc. Selection of 1) in the "problem number" field returns the golfer to the game-interactive recording mode.

Figure 15:
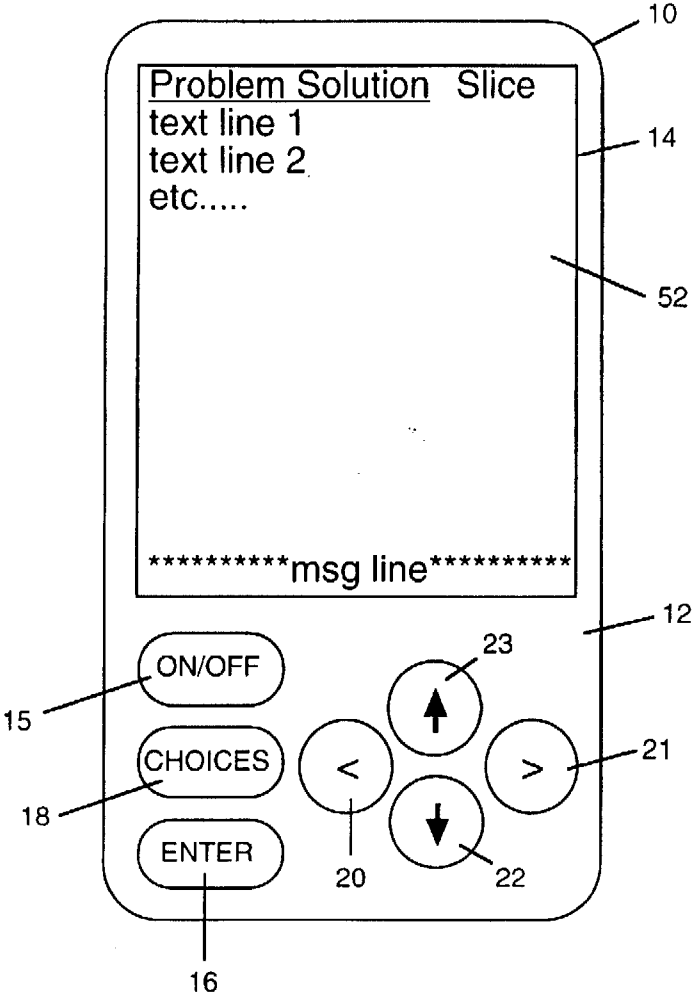
FIGS. 14 and 15 are screens in a game-interactive advice module.

Once the "problem number" has been entered in screen 51, pressing enter key 16 passes control to the problem solution screen 52 of FIG. 15. Depending upon the problem number selected in screen 51, a suitable message in the form of a series of text lines appears on screen 52 to correct the problem. Pressing the enter key again returns the golfer to the golf problem screen 51 for more advice or for return to the game-interactive recording mode.

The golf problem screen 51 can comprise more than a single screen, depending on the number of problems addressed by the program.

Figure 17:
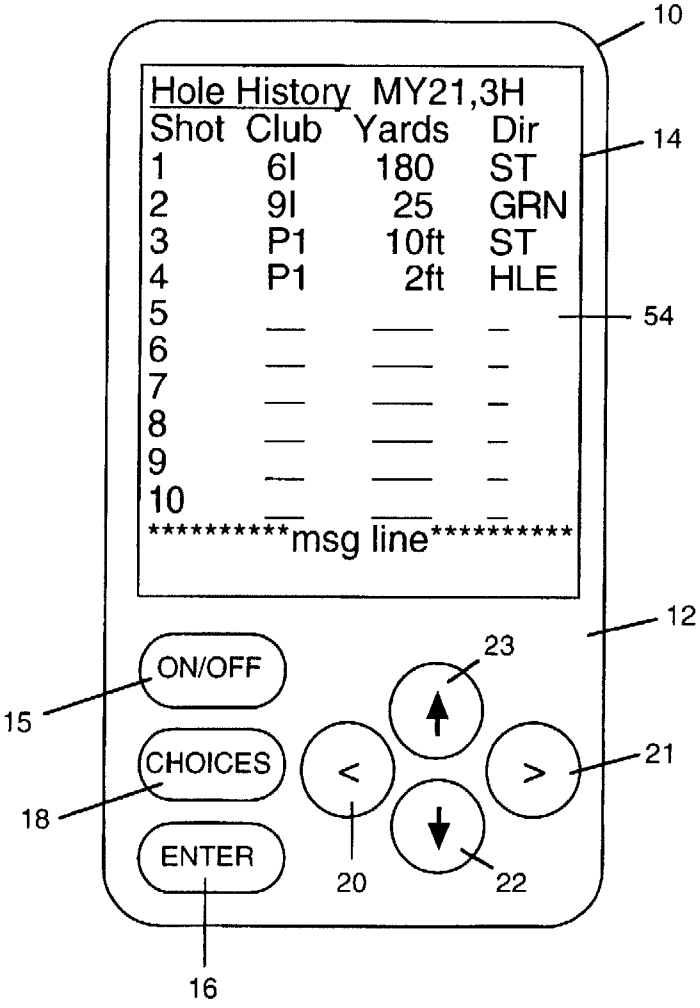
FIGS. 16 and 17 are screens in a game-interactive fact-report module.
Figure 16:
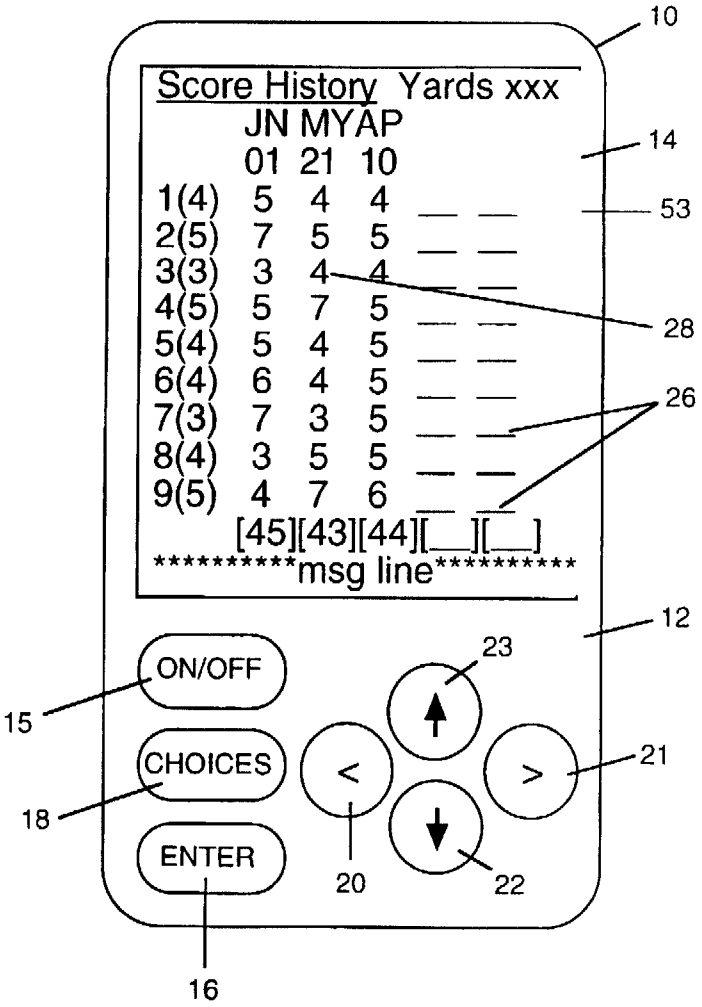

Another advice/feedback mode available from the game-interactive reporting modes is "game play facts" including fact-reporting "score history screen" 53 and "hole history screen" 54 as shown in FIGS. 16 and 17. Score and hole history screens 53,54 are automatically compiled and stored by the computer for past games. As shown in FIG. 16, score history screen 53 lists the scores per hole for the last five times that course was played. The par value for each hole is listed in parentheses next to the hole number.

Selection of the game play facts mode initially passes control to score history screen 53. Tab cursor 28 can be moved among the fields 26 of score history screen 53 using tab 20,21 in the manner earlier described. Once a particular hole is selected with the tab cursor, pressing enter key 16 passes control to hole history screen 54 providing detailed information for each "shot" made on that hole on that date: "club", "yards", and "direction."Pressing enter key 16 in hole history screen 54 returns control to score history screen 53.

The third game-interactive advice/feedback mode available in the illustrated embodiment of FIG. 2 is game play statistics module 55,56,57 shown in FIGS. 18, 19 and 20.

Club summary screen 55 displays an initial average of "yards" and "accuracy" for each club. By entering a club designation (e.g., 1*w*, 2*w*, 3*i*, etc.) in the "club" field 26 of club summary screen 55, control is passed to the club statistics screen 56 in FIG. 19 displaying the average yards for that particular club under varying extrinsic factors such as ground or weather conditions, as well as more-detailed information on accuracy such as the percentage of shots that are hooked, sliced, put on the green or fairway, etc. Pressing enter key 16 returns control to club summary screen 55.

Club summary screen 55 in the illustrated embodiment is context-sensitive in that selection of a club typically used for what in golf is referred to as "chip" or "approach" shots to the green passes control to the "chipping" statistics screen 57 as shown in FIG. 20. This screen displays detailed information for the chipping club selected, the detail commensurate with the finesse required for approach or chipping shots.

The above describes the pre-game and game-interactive modes 35,37 found in the game reporting module 34 of FIG. 2. All of the data, both performance and extrinsic factors, selected during the pregame and game-interactive modes (i.e., before and during the player's golf game) is automatically stored in the memory until intentionally erased or altered by the golfer. It should be noted that turning the unit off will not erase the data as the data is stored in non-volatile memory. Given the limits on a microprocessor for a hand-held unit, in the illustrated embodiment only the previous hundred golf games are stored per course, continuously updated as new games are played. This stored information is reviewed, sorted and averaged by the statistical reporting module 58 to create a number of statistical reports 64 which can be retrieved by the golfer from statistics module 58.

Figure 12A:
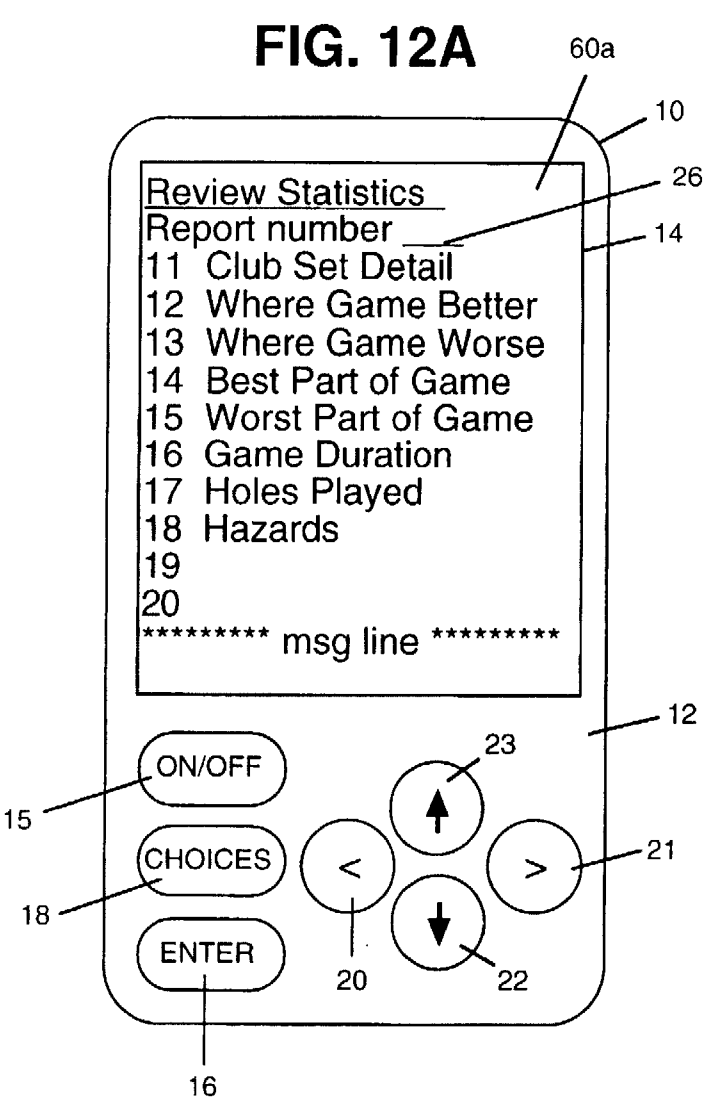
FIGS. 12 and 12*a* are statistical report menus in a statistics mode according to FIG. 2.
Figure 12:
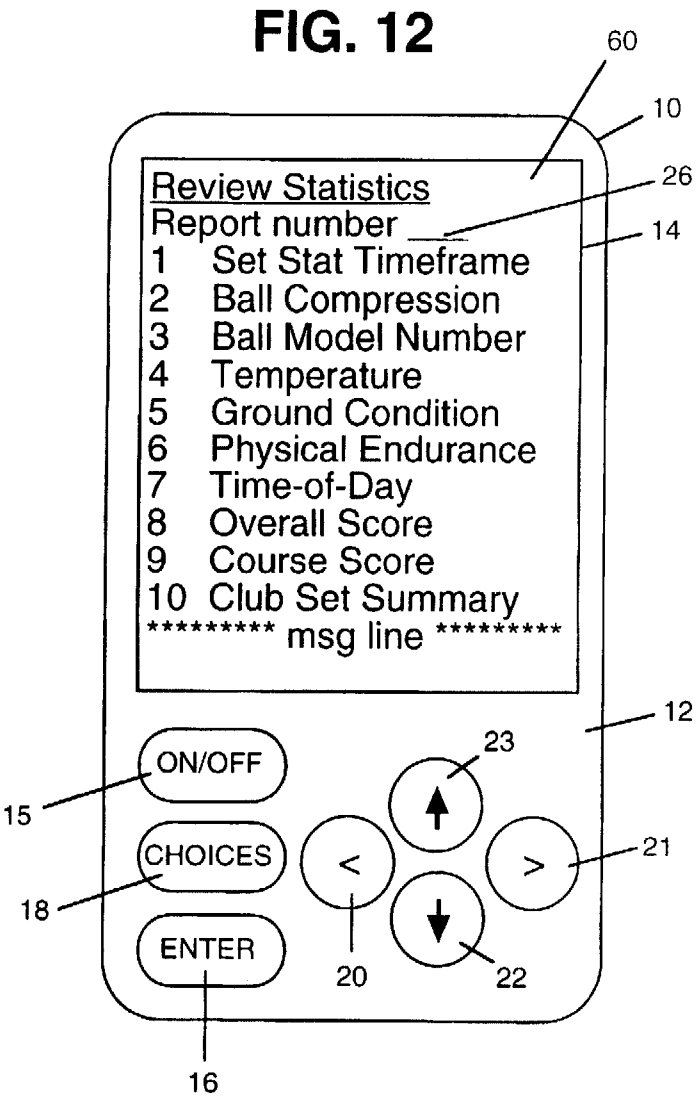

Referring now to FIGS. 2 and 12, 12*a*, an illustrated example of statistics reports menu 60 is shown listing nineteen available statistical reports. Among the available statistical reports are several pertaining to the effects of both player performance and extrinsic factors on the player's game. For example, the "Physical Endurance" report identifies the outcome of a player's intrinsic limitations on performance. Similarly, the "temperature" report provides information on the effects of an extrinsic variable, weather, on game play. In the illustrated embodiment the large number of reports requires them to be divided into two separate screens. These reports can be retrieved by the golfer by selecting the corresponding number in the "report" field 26 using the value scroll keys 22,23 and pressing enter key 16. The appropriate report is then displayed on display 14, for example the "ball compression" statistics screens shown in FIG. 24.

Figure 13:
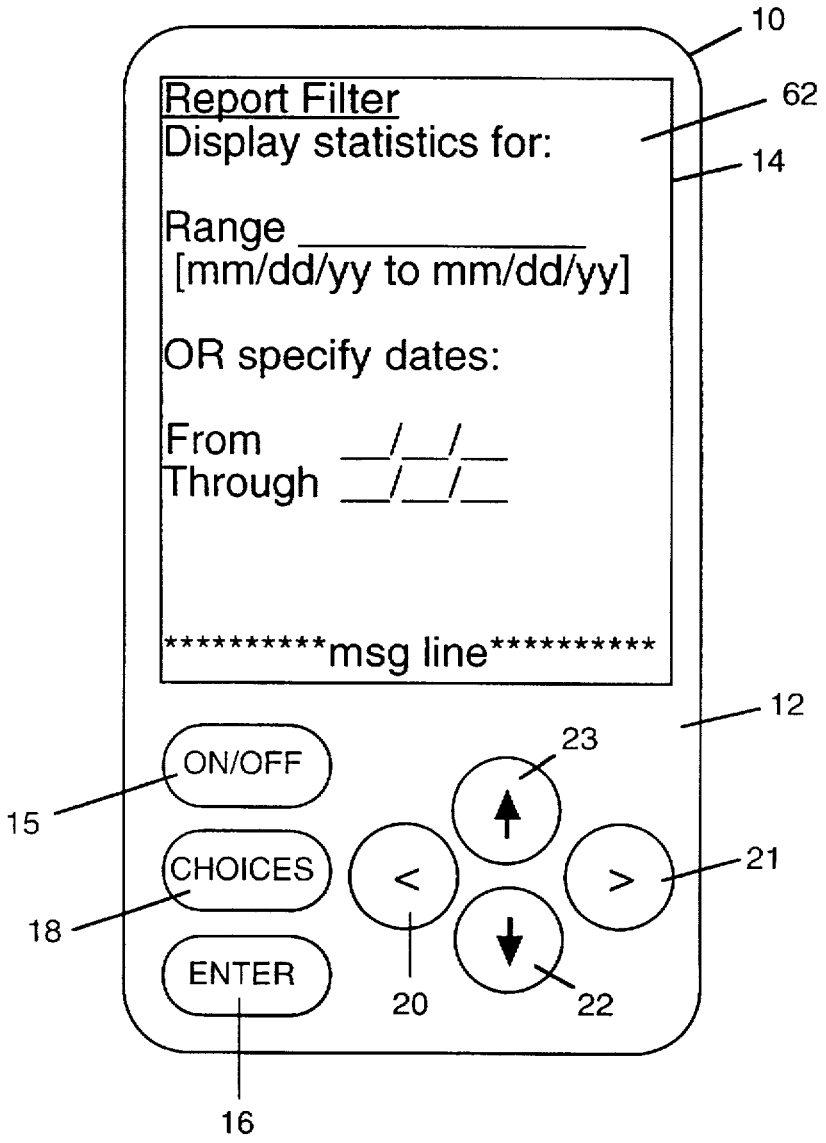
FIG. 13 is a selection criteria screen in a statistics mode according to FIG. 2.

An option available in the statistics reports menu 60 is 1) "set statistical timeframe" which, if selected, passes control to "selection criteria" screen 62 as shown in FIG. 13 in which any statistical report 64 subsequently requested is limited to a particular timeframe. Again, using the tab and scroll keys 20,21 and 22,23, the timeframe can be limited to a particular period of time, or to specific dates.

The statistical reports 64 allow only one "choice" of alternate screens once displayed, an "exit" to the statistics reports menu 60. From the statistics reports menu 60 the user can return to the first menu screen 32 using the choices key 18. The user may end the statistical reporting mode by pressing the on/off button 15 at any time.

Figure 28:
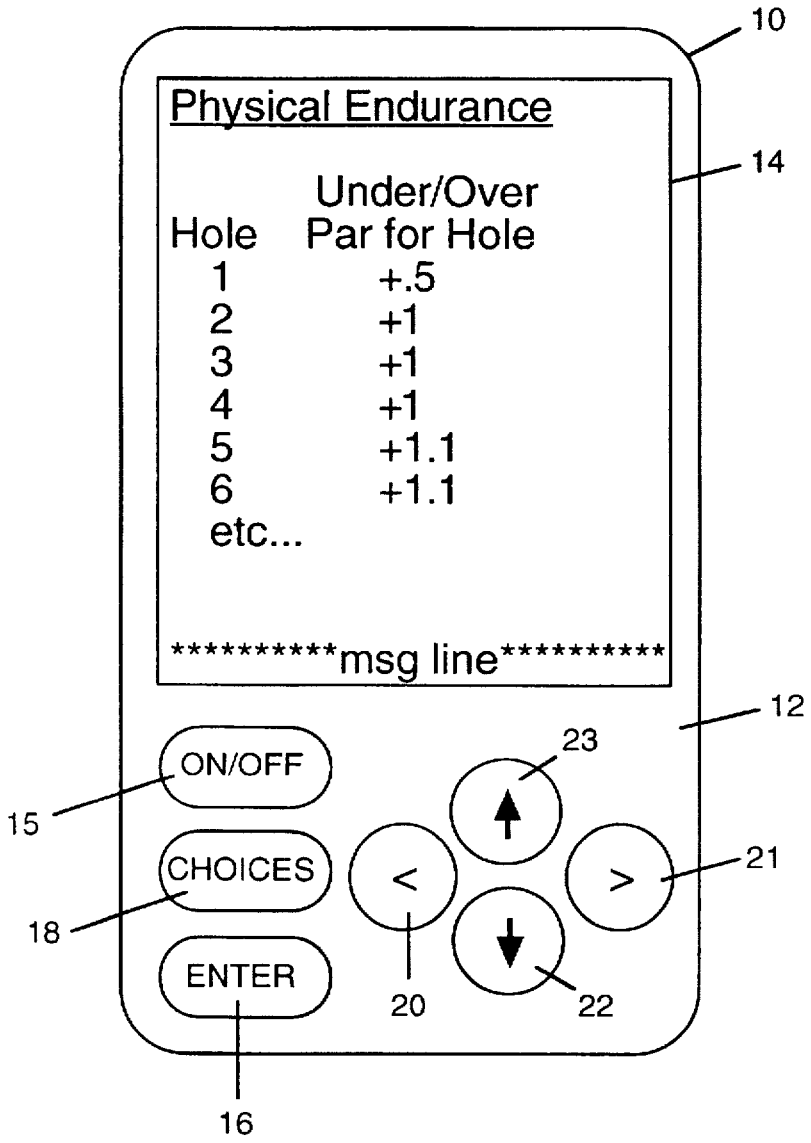
Figure 29:
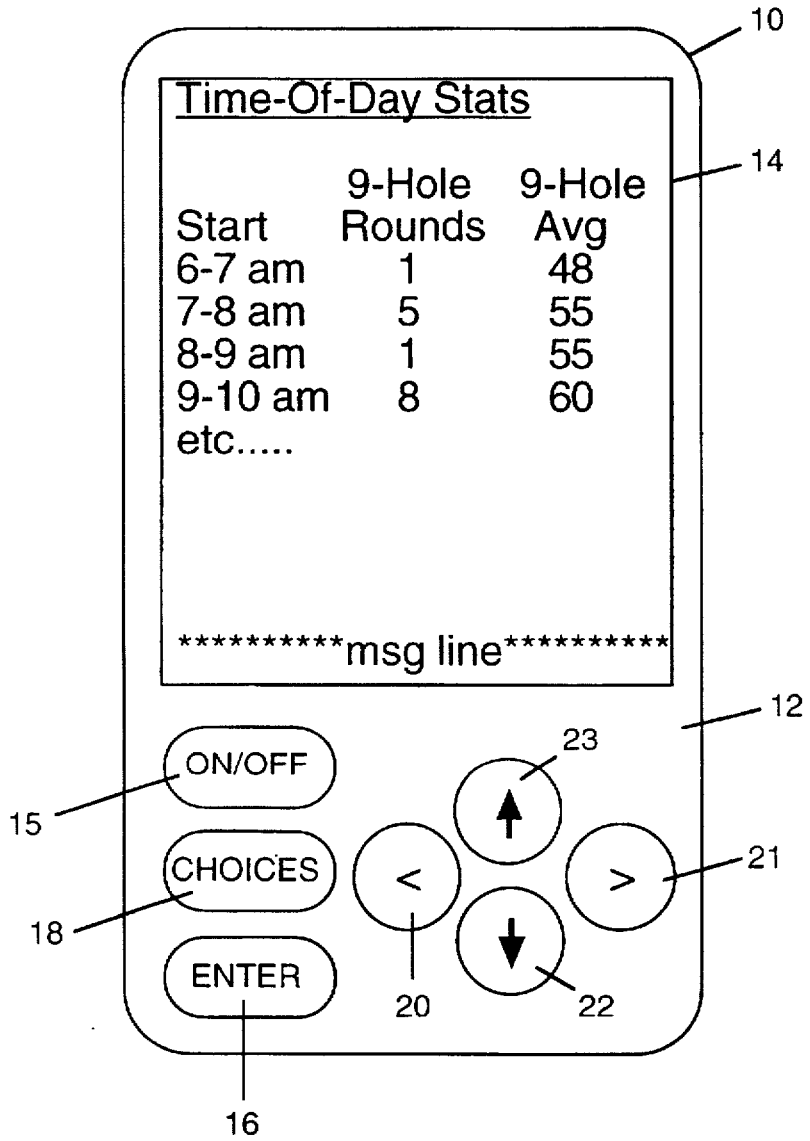
Figure 30:
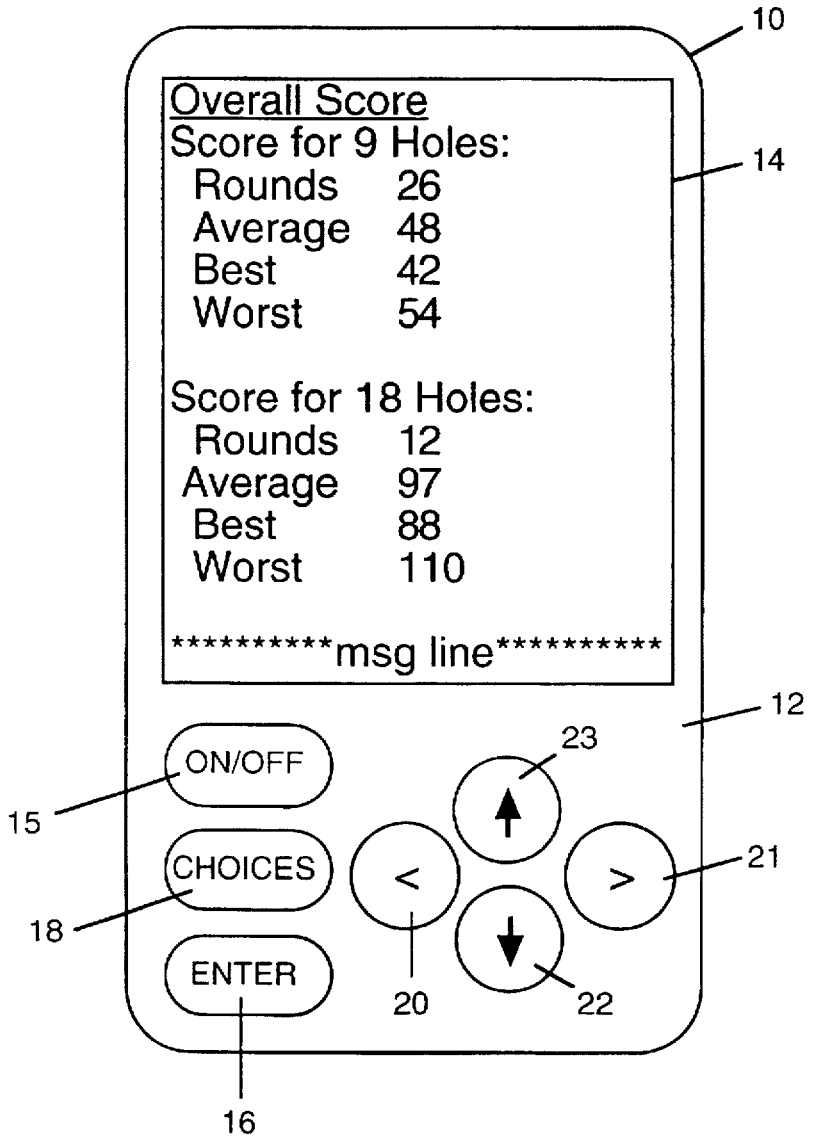
Figure 31:
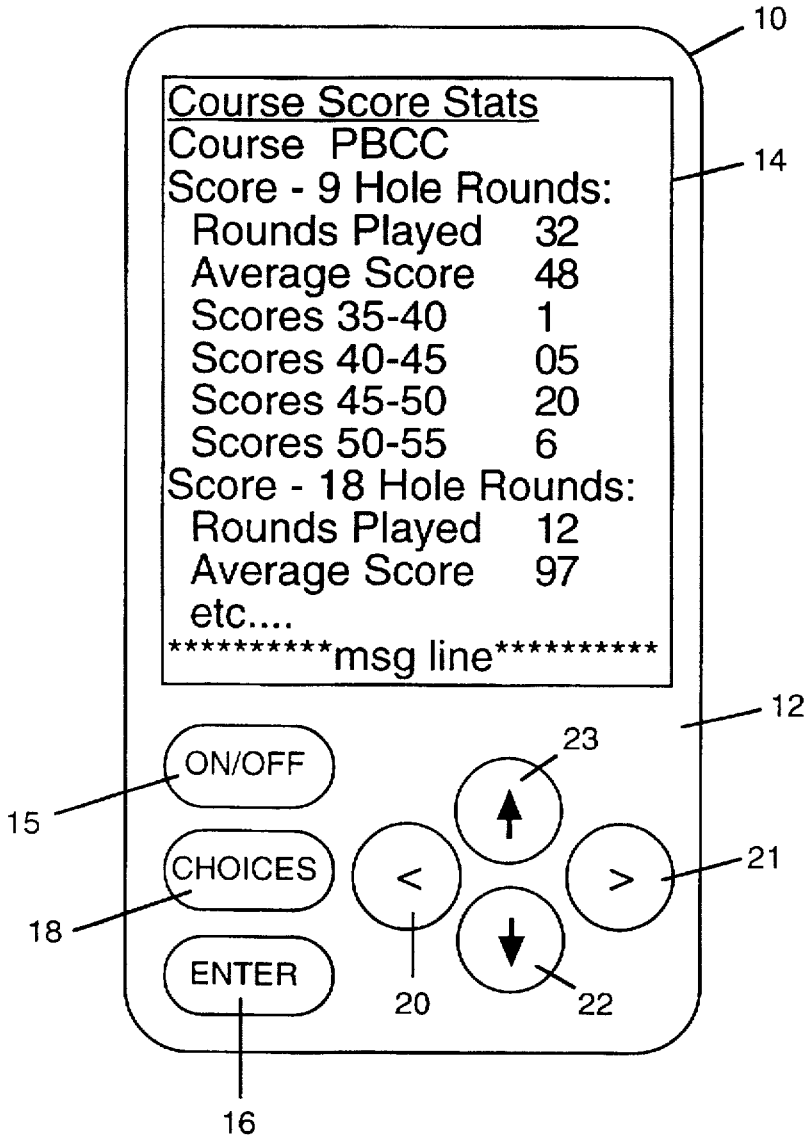
Figure 33:
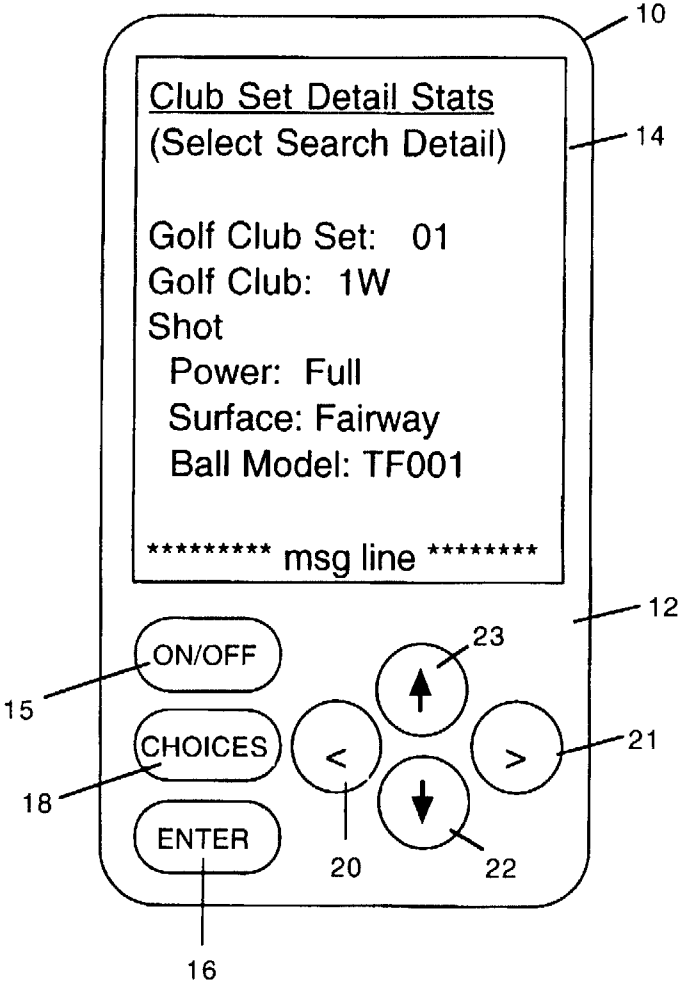
Figure 34:
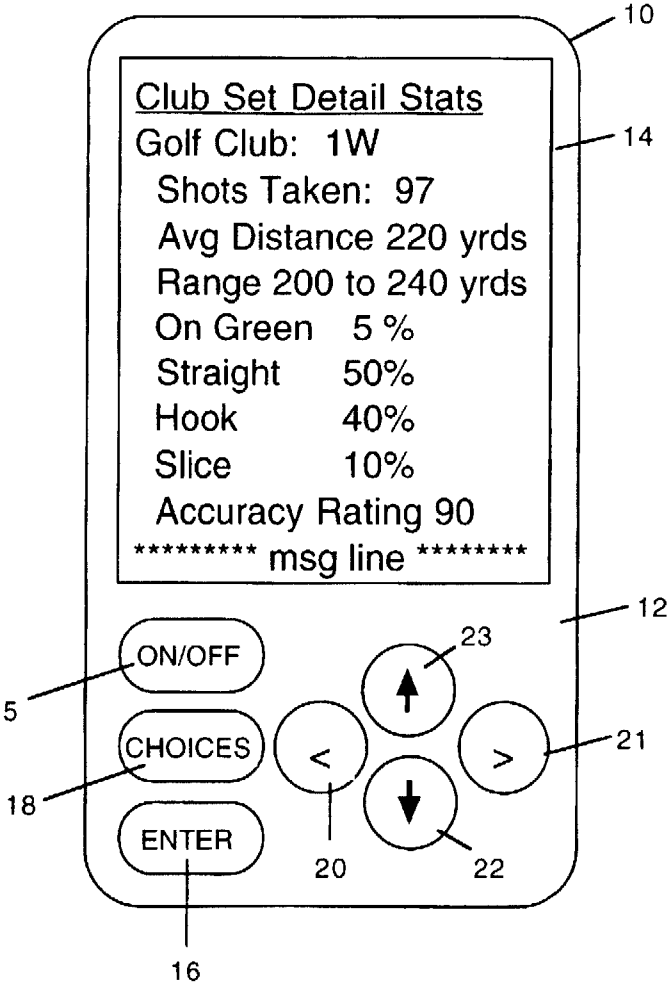
Figure 35:
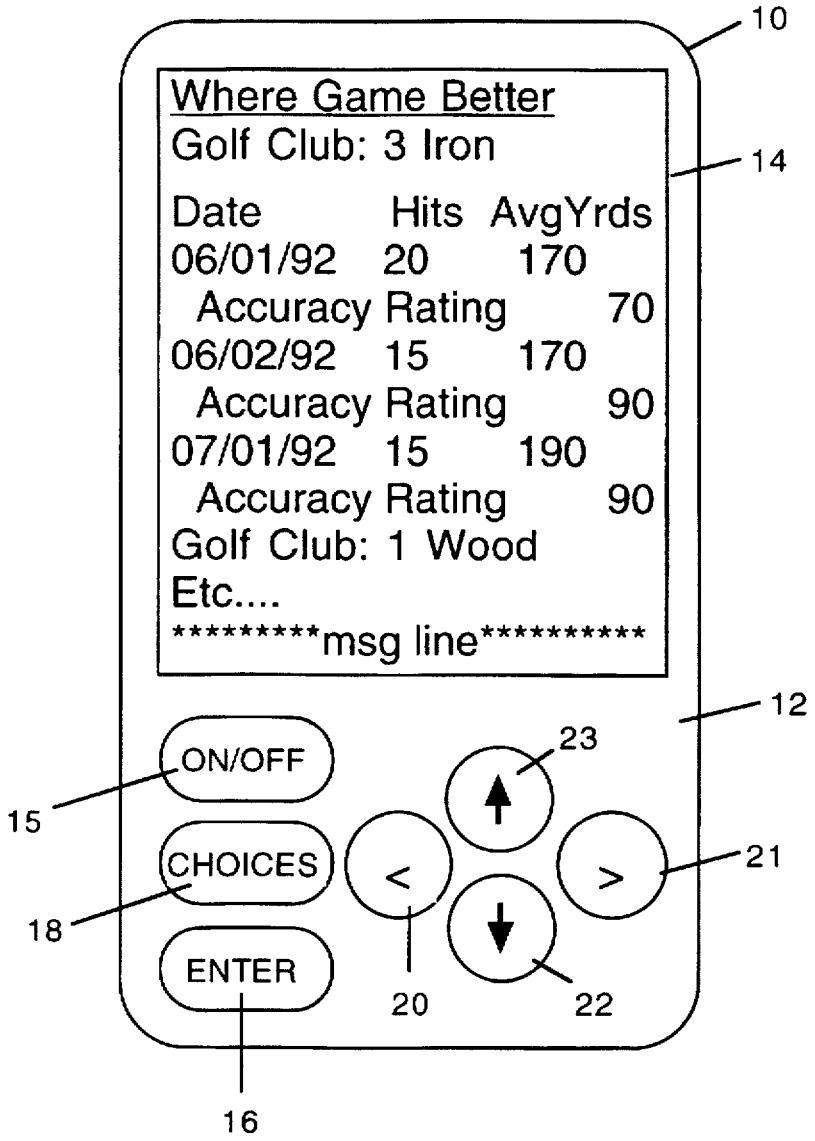
Figure 36:
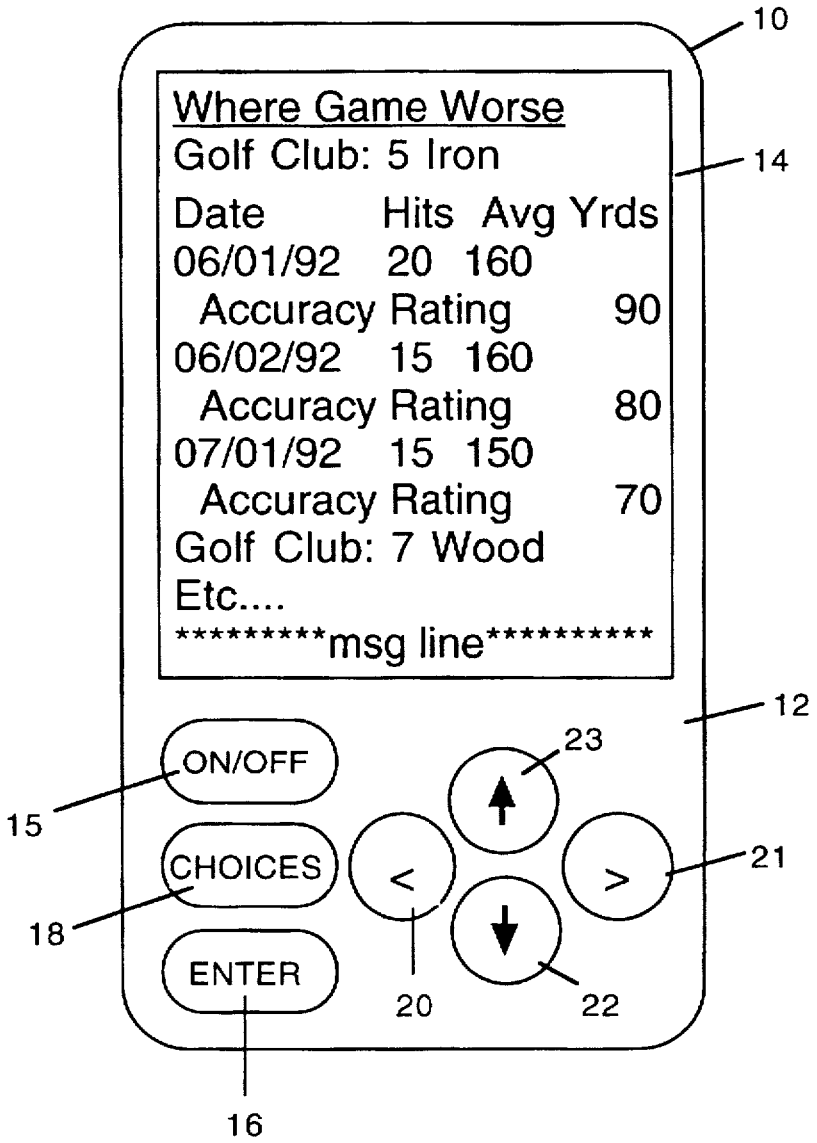
Figure 37:
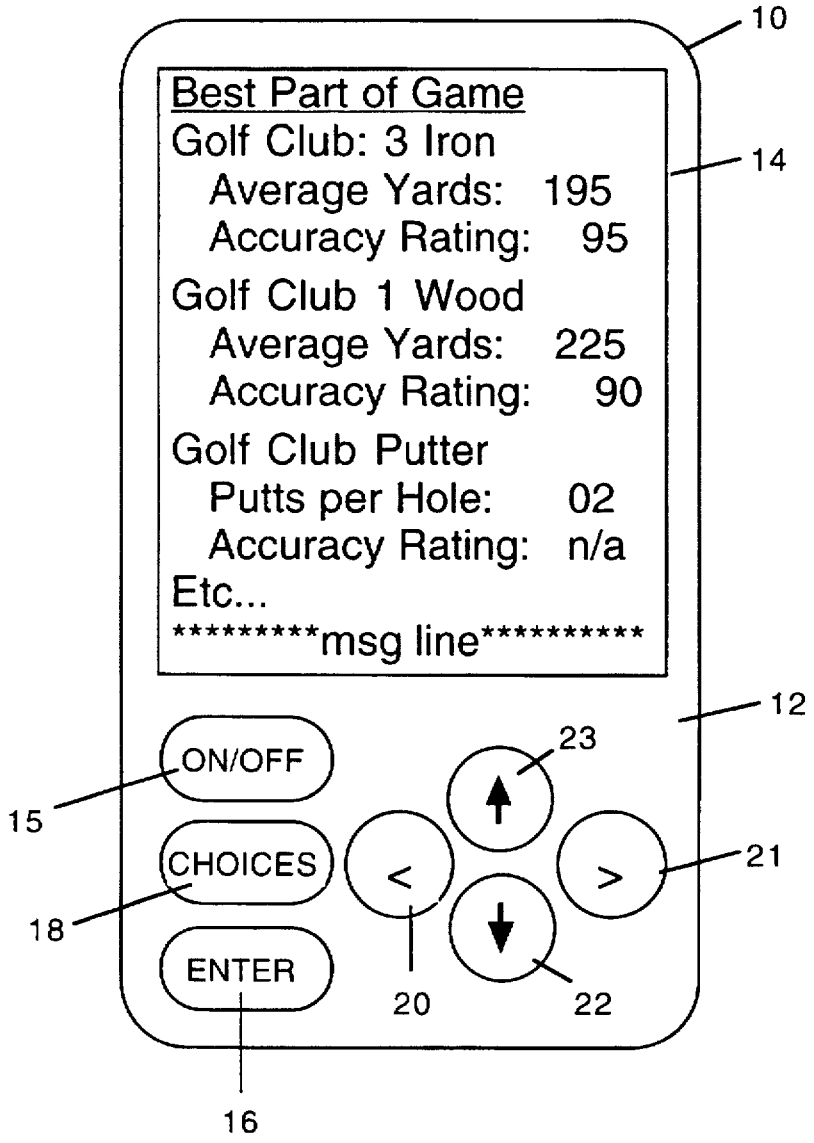
Figure 38:
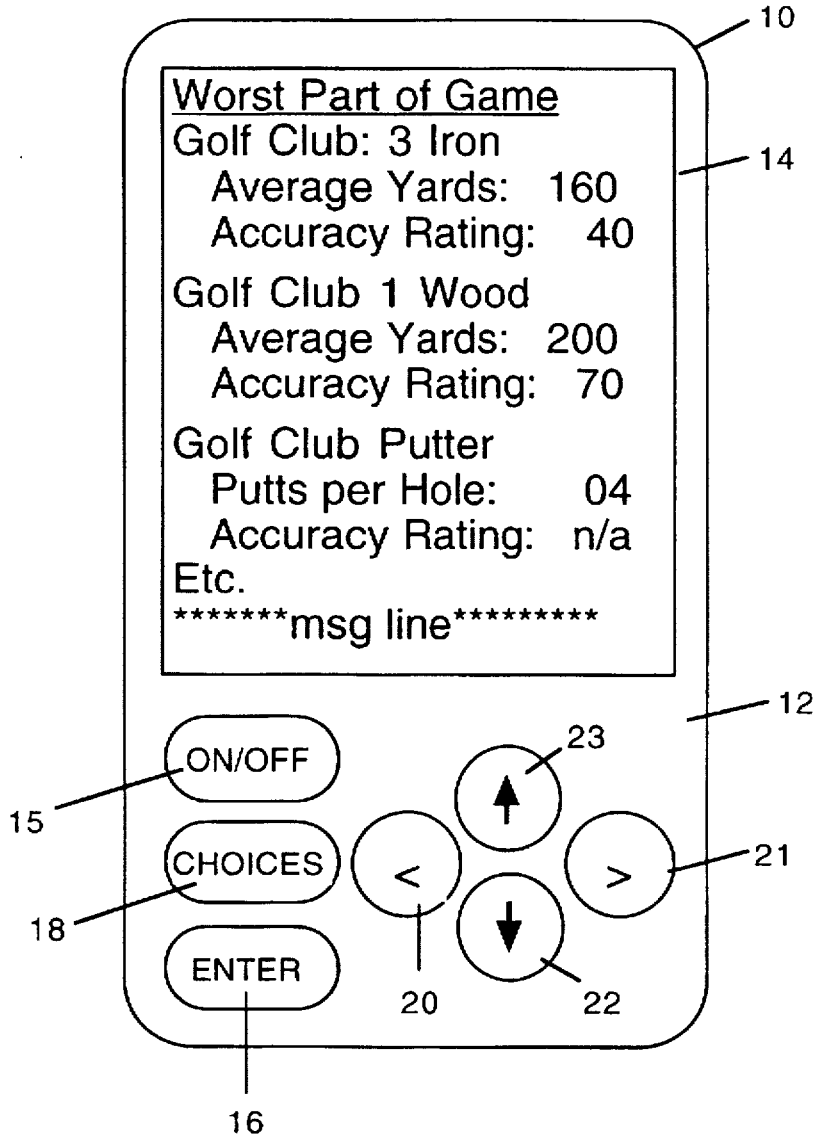
Figure 39:
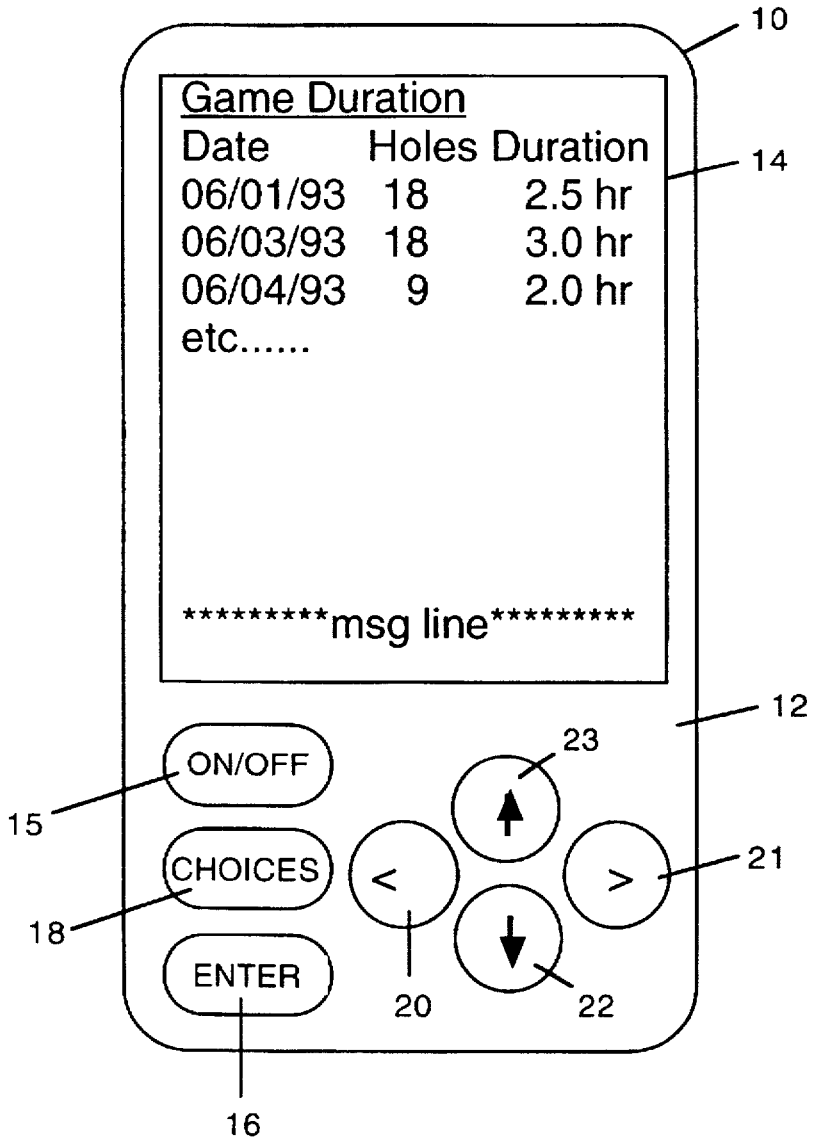
Figure 40:
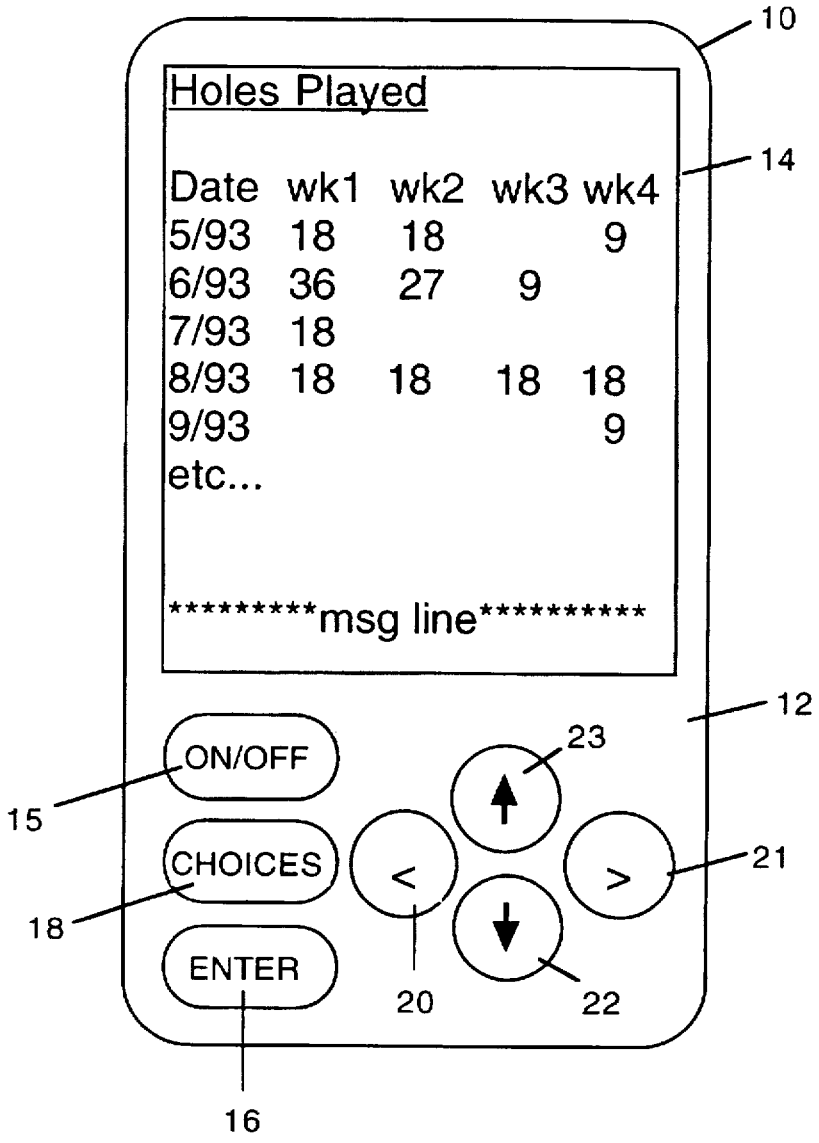
Figure 41:
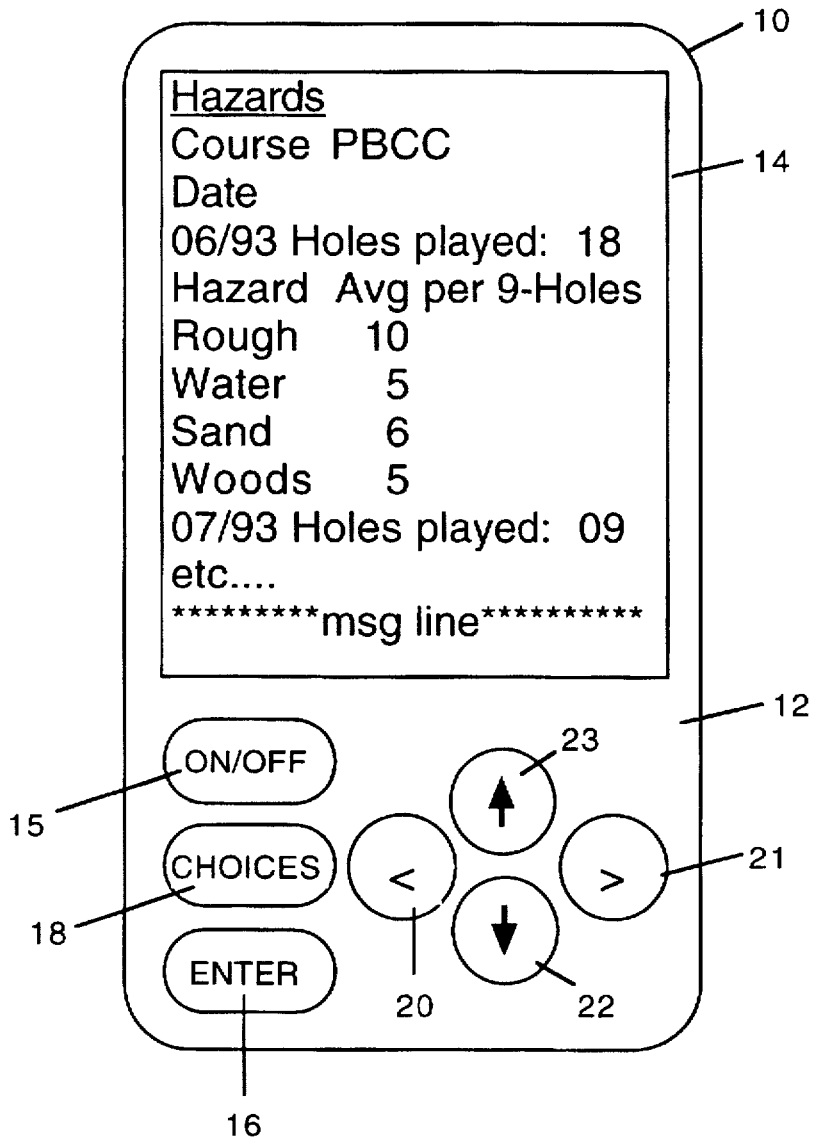

Additional illustrated examples of statistical report screens 64, available from statistics reports menu 60, are shown in FIGS. 24–41. As depicted, a number of reports are shown in the illustrated embodiment, including reports relating extrinsic factors to player performance, a partial listing of potential screens and reports that display general performance statistics include: club summary screen (FIG. 18), approach/chipping statistics (FIG. 20), practice range statistics (FIG. 21), overall score report (FIG. 30), course score report (FIG. 31), clubset detail specify screen (FIG. 33) and clubset detail report (FIG. 33a), physical endurance report (FIG. 28), where game better report (FIG. 34), where game worse report (FIG. 35), best part of game (FIG. 36), worst part of game report (FIG. 37), game duration report (FIG. 38), holes played report (FIG. 39), and hazards report (FIG. 40). One skilled in the art could envision numerous additional performance related reports.

The approach/chipping statistics (FIG. 20) is available for review during game play and provides a means for player to select the most appropriate club for approach or chip shots. Other game performance reports included in the previous paragraph provide summary and trend information to assist a player in assess overall game performance and in identifying specific game play strengths and weakness.

A partial listing of potential reports displaying information on extrinsic factors and their effect on performance include: fairway statistics (FIG. 19), ball compression report (FIG. 24), ball model report (FIG. 25), temperature report (FIG. 26), ground condition report (FIG. 27), time-of-day report (FIG. 29), and club set summary report (FIG. 32). One skilled in the art could envision numerous additional outside factor reports such as game scores by ball model, game scores by ball compression, club performance at each temperature range, and listing of specific outside factors in order of greatest impact on game score.

The fairway statistics report (FIG. 19) is available for review during game play and provides a means for player to evaluate the impact of ground conditions on club distance and to recall club directional tendencies. This screen is ideally suited to assist a player in selecting the most appropriate club for the current shot under consideration.

The ball compression report (FIG. 24) provides a means to assess the impact of ball compression on club yardage. It provides information to assist a player in selecting the ideal ball compression for use during game play. One skilled in the art could envision, additional reports such as game scores versus ball compression used.

The ball model report (FIG. 25) provides a means to assess the impact of varying ball models used on club yardage. It provides information to assist a player in selecting the ideal ball model for usage during game play. Ball model is the identifying name given by a manufacturer a given brand of balls it produces.

The temperature report (FIG. 26) provides a means to assess the impact of varying temperature ranges on game performance. It provides information to assist a player in making game play decisions such as identifying the temperature ranges for optimal game performance.

The ground condition report (FIG. 27) provides a means to assess the impact of the varying ground conditions on game performance. It provides information to assist a player in making game play decisions such as identifying those ground conditions that support optimal game performance.

The time-of-day report (FIG. 29) provides a means to assess the impact of game start time on game performance. It provides information to assist a player in making game play decisions such as identifying the times during the day for game play to obtain best results.

The club set summary report (FIG. 32) provides a means to evaluate multiple clubsets and putter performance. It provides information to assist a player in making game play decisions such as selecting the clubsets and putters to obtain best results.

These listings are not meant provide an exhaustive listing of all reports but merely to provide examples of the many useful reports that can be defined.

Of course, numerous other reports relating the effects of both intrinsic and extrinsic factors on player performance are also possible. Those skilled in the art will contemplate reports such as club performance in relation to various temperatures, game scores by ball model, game scores by ball compression, reports listing in order of magnitude those extrinsic factors impacting a player's ability on a given day or over the course of numerous games, and so on. It will be clear to those skilled in the art what statistical information is displayed and how it is related to the game of golf, particularly in view of the foregoing written description of the inventions.

Figure 22:
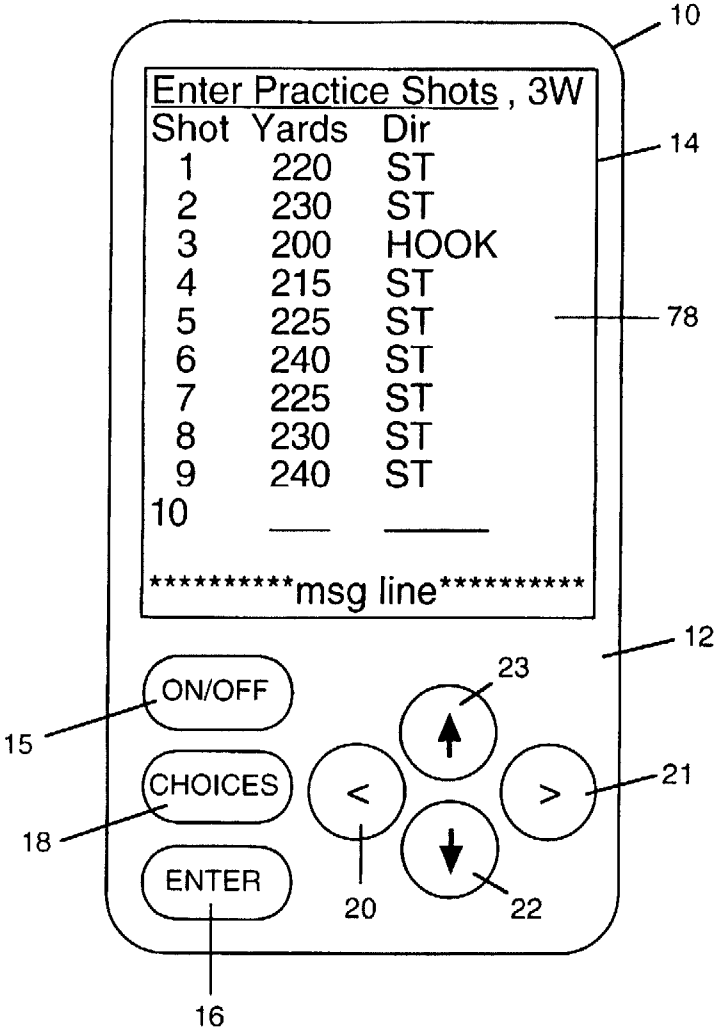
FIGS. 21 and 22 are screens in a practice range module according to the present invention.
Figure 21:
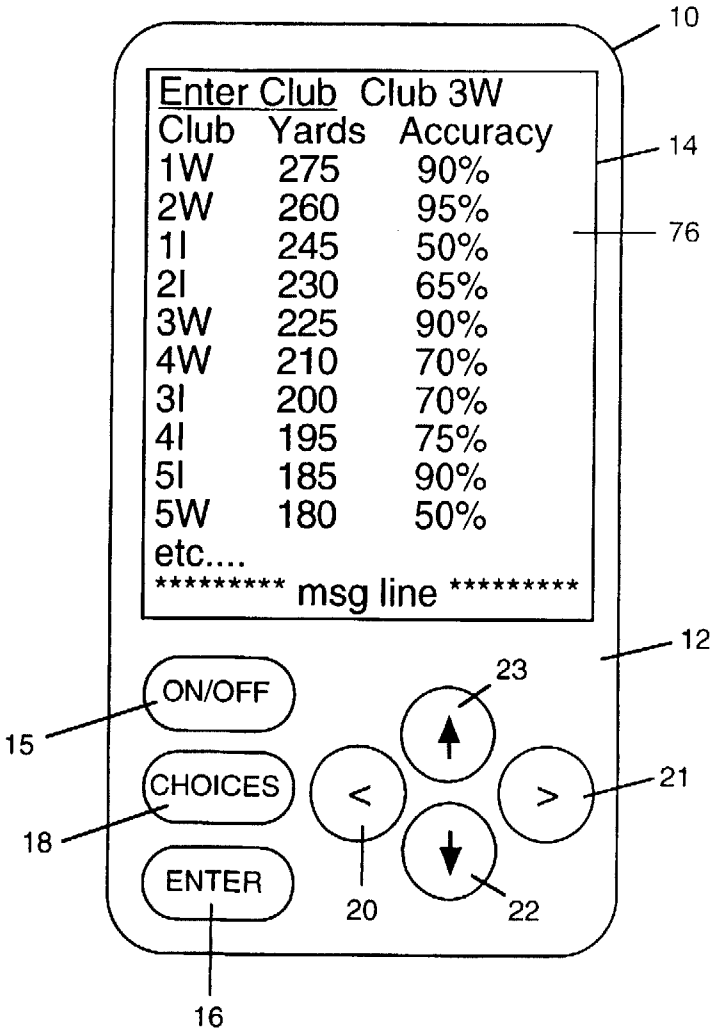
Figure 23:
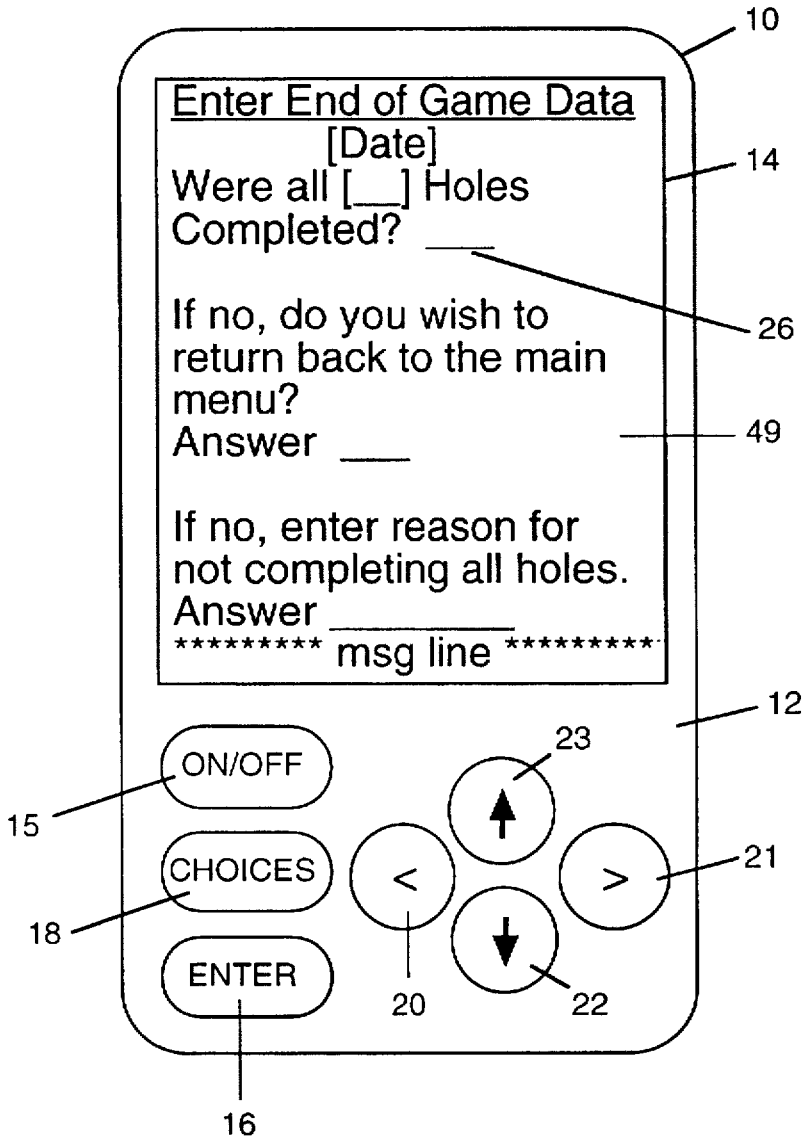
FIG. 23 is one embodiment of an end of game screen in a game-interactive mode according to FIG. 2.

In yet a further embodiment of the illustrated invention, the initial choice between game recording module 34 and statistics reporting module 58 is supplemented with a third choice, practice range module 74 as shown in FIGS. 21 and 22. Practice range module 74 includes a practice range statistics screen 76 in FIG. 21 and a practice range entry screen 78 in FIG. 22. Practice range statistics screen 76 includes a single "club" data input field 26 and a comprehensive listing of average "yards" and "accuracy" values for the clubs in a golf set. The "yards" and "accuracy" statistics in screen 76 in the illustrated embodiment are based on the last ten shots with that club as entered by the user in practice range entry screen 78. Once in the practice range module 74, control is initially passed to practice range statistics screen 76. Pressing enter key 16 passes control to practice range entry screen 78. Practice range entry screen 78 contains "yards" and "direction" data input fields for ten shots in the illustrated embodiment. After each shot the user, using scroll keys 22,23 selects and records the "yards" and "direction" for that shot in screen 78. If desired, additional practice range entry screens (not shown) for shots 11–20, 21–30, etc. can be provided, accessible by filling in the previous screen and pressing enter key 16. Return to the practice range statistics screen 76 from practice range entry screen 78 is effected by pressing enter key 16 at the end of the practice session (after all practice range entry screens have been filled), or by providing a "choices" menu in association with practice range screen 78.

While the above description is of a particular illustrated embodiment, it is not intended to be limiting, as many variations and modifications of the invention lie within the scope of the appended claims. This will be apparent to those skilled in the art. For example, the specific format of any one screen can be customized as desired by the programmer. The types of golf data deemed relevant for adequate recording and reporting are also subject to variation. The inventive handheld reporting unit and method of operation is of course not limited to the game of golf, as those skilled in the art will be able to adapt the invention to almost any sport or game for which it is desirable to record and report a large amount of data. Golf is the game for which the invention is best suited, but not the only game to which it can be applied.

It is also possible to provide suitable ports or connections in handheld unit 10 to permit interface with a personal computer having a larger memory. This could be a mechanical cable connection, or an infrared or other remote connection. In this manner a larger body of statistical formation over long periods of time can be stored for trieval and review by the user. It will be understood that the foregoing description of an illustrated embodiment of the invention is not intended to limit the invention beyond the scope of the following claims.

I claim:

1. An apparatus for recording and reporting golf information to increase a player's ability to improve from experience, the apparatus comprising:

a self-contained computer unit having a memory, a power source and a display for selectively displaying a plurality of information screens and associated data stored in the memory, the information screens including screen-dependent data input fields for the associated data;

key entry means for retrieving and selectively displaying the information screens from the memory on the display, and for retrieving, selecting, and recording the associated data with each information screen, wherein the key entry means includes first key means comprising one entry key for selectively displaying information screens, second screen-dependent field select key means for selecting a particular data input field of predefined data on a displayed screen, the second screen-dependent field select key means comprising two bi-directional tab keys for scrolling in opposite directions through the data input fields on a displayed information screen, and third screen-dependent value select key means for displaying and selectively recording or altering selected data in a selected data input field, the third screen-dependent value select key means comprising two bi-directional scroll keys for scrolling in opposite directions through the predefined data associated with the data input field on the displayed information screen.

2. Apparatus as defined in claim 1, wherein the first key means permits changing of the information screens in sequential fashion, and the first key means further includes choice means for non-sequential selection or changing of information screens.

3. Apparatus as defined in claim 2 wherein the choice means is screen-dependent to provide a customized set of screen-changing options for a displayed information screen.

4. Apparatus as defined in claim 1, wherein the information screens stored in the memory comprise one or more pre-game parameter recording information screens, one or more game-interactive recording information screens; and one or more post-game statistic report information screens.

5. Apparatus as defined in claim 4, wherein the information screens further include one or more game-interactive fact report information screens.

6. Apparatus as defined in claim 4, wherein the information screens further include one or more game-interactive golf advice information screens.

7. A method for recording and reporting golf information to increase a player's ability to improve from experience, comprising the following steps:

storing a plurality of pre-game, game-interactive and post-game information screens in a memory of a computer unit having a display for selectively displaying one or more of the information screens;

entering a pre-game mode in which one or more pre-game information screens are displayed in sequential fashion to prompt entry of data defining parameters of an upcoming game, and in which a choice is provided among a plurality of game-interactive information screens for subsequently recording data during the upcoming game defined by the parameters entered in the pre-game mode, wherein the number of pre-game information screens displayed in sequential fashion in the pre-game mode is determined by which of the game-interactive information screens is chosen;

entering the game-interactive mode to display the chosen game-interactive information screen;

entering data in the chosen game-interactive information screen corresponding to the game as the game is played, and simultaneously recording entered data in the memory of the computer unit; and providing post-game reports based on the data entered in the chosen game-interactive information screen.

8. A method for recording and reporting golf information to increase a player's ability to improve from experience, comprising the following steps:

storing a plurality of pre-game, game-interactive and post-game information screens in a memory of a computer unit having a display for selectively displaying one or more of the information screens, the information screens including screen-dependent data input fields for entry of data;

displaying in sequential fashion one or more pre-game information screens and prompting entry of data which defines parameters of an upcoming game;

providing a choice among a plurality of game-interactive information screens for recording data during the game defined by the parameters entered in the pre-game information screens;

displaying a chosen game-interactive information screen;

entering data in the chosen game-interactive information screen corresponding to a game as the game is played, and simultaneously recording entered data in the memory of the computer unit;

providing post-game reports based on the data entered in the game-interactive information screen; and, providing one or more game-interactive advice/feedback information screens.

9. A method for recording and reporting golf information in a manner tending to increase a player's ability to improve from experience, comprising the following steps:

providing a computer unit with a memory, a display, and data selection entry keys;

storing a plurality of information screens of golf play information in the memory of the computer unit, the information screens including screen-dependent data input fields corresponding to the golf play information in each screen;

selectively displaying information screens on the display in a logical sequence of pre-game and game-interactive screens, the pre-game information screen prompting entry of data which defines parameters of a game to be played and a game-interactive screen on which data is recorded for the game;

selecting data input fields on a displayed information screen;

selecting from stored golf information corresponding to one or more chosen data input fields; and storing selected golf information in the memory as statistical or factual reports for retrieval by the user after the game.

10. A method as defined in claim 9, wherein the golf information entered in the pre-game information screen comprises golf play parameters defining an upcoming game, and the golf information entered in the game-interactive information screens comprises golf play data values defining a user's actual performance within the golf play parameters of the game.

11. A method as defined in claim 10, wherein the golf play parameters are selected and entered in the pregame mode, and the golf play data values are selected and entered in the game-interactive mode.

12. A method as defined in claim 10, wherein golf information entered in the pre-game information screen further comprises extrinsic factors having an effect on a player's performance.

13. An apparatus for recording and reporting sports and game information to increase a player's ability to improve from experience, the apparatus comprising:

a self-contained computer unit having a memory, a power source and a display for selectively displaying a plurality of information screens and associated data stored in the memory, the information screens including screen-dependent data input fields for the associated data;

a plurality of pre-game, game-interactive and post-game information screens stored in the memory of the computer unit;

means for displaying a pre-game information screen and prompting entry of data which defines parameters of an upcoming game, and means for subsequently displaying a game-interactive information screen corresponding to a game-interactive mode defined by the parameters selected in the pre-game information screen;

entry key means for changing information screens in sequential fashion, the entry key means comprising one entry key:

choice key means for non-sequential selection or changing of information screens the choice key means comprising one choice key;

field select key means for choosing a particular data input field on a displayed information screen, the field select key means comprising two bi-directional keys; and value select key means for displaying and selectively recording data in the chosen data input field the value select key means comprising two bi-directional keys.

14. A method for recording and reporting golf information to increase a player's ability to improve from experience, comprising the following steps:

storing a plurality of pre-game, game-interactive and post-game information screens in a memory of computer unit having a display for selectively displaying one or more of the information screens, the information screens including screen-dependent data input fields for entry of data;

displaying in sequential fashion one or more pre-game information screens and prompting entry of data which defines parameters of an upcoming game;

providing a choice among a plurality of game-interactive information screens for recording data during the game defined by the parameters entered in the pre-game information screens;

displaying a chosen game-interactive information screen;

entering data in a chosen game-interactive information screen corresponding to a game as the game is played, and simultaneously recording the entered data in the memory of the computer unit;

providing post-game reports based on the data entered in the game-interactive information screen; wherein, the game-interactive information screens comprise a first information screen with a first detail level of recording, and a second information screen with a second detail level of recording.

15. A method for recording and reporting golf information to increase a player's ability to improve from experience, comprising the following steps:

storing a plurality of pre-game, game-interactive and post-game information screens in a memory of a computer unit having a display for selectively displaying one or more of the information screens, the information screens including screen-dependent data input fields for entry of data;

displaying in sequential fashion one or more pre-game information screens and prompting entry of data which defines parameters of an upcoming game;

providing a choice among a plurality of game-interactive information screens for recording data during the game defined by the parameters entered in the pre-game information screens;

displaying a chosen game-interactive information screen;

entering data in the chosen game-interactive recording screen corresponding to the game as the game is played, and simultaneously recording entered data in the memory of the computer unit; and providing post-game reports based on the data entered in the game-interactive reporting information screen; wherein, the pre-game information screens are provided with means for selecting non-sequential option screens.

16. A method for recording and reporting golf information to increase a player's ability to improve from experience, comprising the following steps:

storing a plurality of pre-game, game-interactive and post-game information screens in a memory of a computer unit having a display for selectively displaying one or more of the information screens, the information screens including screen-dependent data input fields for entry of data;

displaying in sequential fashion one or more pre-game information screens and prompting entry of data which defines parameters of an upcoming game;

providing a choice among a plurality of game-interactive recording information screens for recording data during the game defined by the parameters entered in the pre-game information screens;

displaying a chosen game-interactive recording information screen;

corresponding to the game as the game is played, and simultaneously recording entered data in the memory of the computer unit; and providing post-game reports based on the data entered in the game-interactive reporting information screen; wherein, the game-interactive information screens are provided with means for selecting non-sequential option screens.

17. A handheld portable apparatus for recording and reporting golf information to increase a player's ability to improve from experience, the apparatus comprising:

a. self-contained computer unit having a memory, a power source and a display for selectively displaying a plurality of information screens and associated data stored in the memory, the information screens including screen-dependent data input fields for the associated data;

first key entry means for sequentially displaying one or more pre-game information screens in a pre-game mode of operation, and subsequently sequentially displaying one or more game-interactive information screens in a game-interactive mode of operation, the first key entry means comprising one entry key;

second key means for selecting a particular data field on a displayed information screen, the second key means comprising two bi-directional keys;

third key means for selectively recording or altering data in a selected data field, the third key means comprising two bi-directional keys; wherein, the pre-game information screens include means for prompting the entry of data which defines parameters of an upcoming game, and means for selecting one of a plurality of game-interactive information screens representing different levels of data-recording detail in the game-interactive mode.

18. A method for recording and reporting golf information to increase a player's ability to improve from experience, comprising the following steps:

providing a computer unit with a memory, a display and data selection entry keys;

storing a plurality of information screens of golf play information in the memory of the computer unit, the information screens including screen-dependent data input fields corresponding to the golf play information of each information screen;

providing a pre-game mode of data entry in which one or more pre-game information screens are displayed to prompt the entry of data which defines parameters of an upcoming game, and providing a choice of at least one of a plurality of game-interactive information screens in a subsequent game-interactive mode of operation representing different levels of data recording detail;

entering the game-interactive mode during the game defined in the pre-game mode, and displaying a chosen game-interactive recording information screen for entry of game data as the game is played; and storing the recorded golf information in the memory as statistical or factual reports for retrieval by the player after the game.

19. A method for recording and reporting golf information to increase a player's ability to improve form experience, comprising the following steps:

storing a plurality of pre-game, game-interactive and post-game information screens in a memory of a computer unit having a display for selectively displaying one or more of the information screens;

displaying in sequential fashion one or more pre-game information screens and prompting entry of data which defines parameters of an upcoming game;

providing a choice among a plurality of game-interactive information screens for recording data during the game defined by the parameters entered in the pregame information screens;

displaying a chosen game-interactive information screen;

entering data in the chosen game-interactive information screen corresponding to a game as the game is played, and simultaneously recording entered data in the memory of the computer unit;

providing post-game reports based on the data entered in the game-interactive information screen; wherein, the data entered in the one or more pre-game information screens includes extrinsic factors having an effect on a player's performance.

20. A method for recording and reporting golf information, comprising the following steps:

storing a plurality of pre-game, game-interactive and post-game information screens in a memory of a computer unit having a display for selectively displaying one or more of the information screens, the information screens including screen-dependent data input fields for the entry of data;

displaying one or more pre-game information screens and prompting selection and recording of data defining extrinsic factors having an effect on player performance;

subsequently providing a choice from among a plurality of game-interactive recording information screens for selection and recording of data while the game is played;

displaying a chosen game-interactive recording information screen;

selecting and recording data in the chosen game-interactive recording information screen corresponding to the game as the game is played; and providing post-game report information screens based on the data entered in both the pre-game and game-interactive information screens.

21. The method of claim 20, wherein the step of prompting selection and recording of data defining extrinsic factors further includes selection and recording of parameters of the upcoming game.

22. The method of claim 20, wherein the pre-game information screens are provided with means for selecting non-sequential option screens.

23. The method of claim 20, wherein the game-interactive information screens are provided with means for selecting non-sequential option screens.

24. The method of claim 20, wherein the game-interactive information screens comprise a first information screen with a first level of recording, and a second information screen with a second level of reporting.

25. The method of claim 20, wherein the post-game report information screens include one or more factual and statistical reports based on a relationship between a player's performance in a game and extrinsic variables entered in the one or more pre-game information screens.

26. The method of claim 25, further including the step of providing one or more game-interactive advice/feedback screens as a game is played.

27. The method of claim 26, wherein the one or more game-interactive advice/feedback screens include statistical and factual information based on the data entered in both the pre-game and game-interactive information screens.

28. The method of claim 27, wherein the one or more game-interactive advice/feedback screens include at least one display which assists a player in selecting a golf club for the game as the game is played.

29. The method of claim 28, wherein the at least one display assisting player selection of a golf club includes information based on a relationship between extrinsic factors and player performance.

30. A method for recording and reporting information on a game of golf using a computer unit having a memory and a display for selectively displaying one or more information screens, comprising the following steps:

displaying one or more screens for prompting selection and recording of data;

selecting one or more extrinsic factors having an effect on player performance, and recording corresponding extrinsic factor data associated with a game played;

selecting one or more player performance factors, and recording corresponding player performance data as the game is played; and, computing and displaying statistics correlating the effect of one or more extrinsic factors for which data has been recorded on one or more player performance.

31. The method of claim 30, wherein the statistics are displayed as a report on the effect of one or more extrinsic factors on player performance for assisting the player in selecting a golf club.

32. The method of claim 30, wherein the statistics are displayed as a report on the effect of one or more extrinsic factors on player performance for assisting the player in understanding the effect of the extrinsic factors on player performance.

33. The method of claim 30, wherein the one or more information screens include a pre-game information screen for prompting selection and recording of extrinsic factor data.

34. The method of claim 33, further including the step of displaying a game-interactive information screen which prompts selection and recording of player performance data as the game is played.

35. The method of claim 34, further including the step of displaying a post-game information screen displaying a relationship between extrinsic factors and player performance data.

36. A method for recording and reporting information on a game of golf using a computer unit having a memory and a display for selectively displaying one or more information screens, comprising the following steps:

1) displaying one or more information screens for prompting selection and recording of data;

2) recording extrinsic factor data which has an effect on player performance and which is associated with a game played;

3) recording player performance data as the game is played; and 4) computing and displaying statistics correlating the effect of one or more extrinsic factors for which data has been recorded on recorded player performance.

37. A method for recording and reporting golf information to increase a player's ability to improve from experience, comprising the following steps:

storing pre-game, game-interactive and post-game information screens in a memory of a computer unit having a display for selectively displaying the information screens;

displaying a pre-game information screen and prompting entry of data which defines parameters of a game;

displaying a game interactive information screen for recording data during the game defined by the parameters entered in the pre-game information screen;

providing post-game reports based on the data entered in the game-interactive information screen; wherein, extrinsic factor data is entered in the pre-game information screen to record extrinsic factors having an effect on a player's performance, and the post-game report is further based on extrinsic factor data to display the effect of extrinsic factors on the player's performance.

* * * * *

US005779566C1

(12) EX PARTE REEXAMINATION CERTIFICATE (6730th)

United States Patent
Wilens

(10) Number: US 5,779,566 C1
(45) Certificate Issued: Mar. 31, 2009

(54) HANDHELD GOLF REPORTING AND STATISTICAL ANALYSIS APPARATUS AND METHOD

(75) Inventor: Peter S. Wilens, Troy, MI (US)

(73) Assignee: L & H Concepts, LLC, Macomb, MI (US)

Reexamination Request:
No. 90/008,817, Aug. 9, 2007

Reexamination Certificate for:

| | |
|---|---|
| Patent No.: | **5,779,566** |
| Issued: | **Jul. 14, 1998** |
| Appl. No.: | **08/392,280** |
| Filed: | **Feb. 22, 1995** |

Related U.S. Application Data

(63) Continuation-in-part of application No. 08/058,074, filed on May 4, 1993, now abandoned.

(51) Int. Cl.
*G06F 15/02* (2006.01)
*A63B 57/00* (2006.01)

(52) U.S. Cl. ..... 473/407; 473/409; 473/131

(58) Field of Classification Search ..... None
See application file for complete search history.

(56) References Cited

U.S. PATENT DOCUMENTS

| | | | |
|---|---|---|---|
| 3,665,494 | A | 5/1972 | Baumoel |
| 4,142,236 | A | 2/1979 | Martz et al. |
| 4,220,992 | A | 9/1980 | Blood et al. |
| 4,266,214 | A | 5/1981 | Peters, Jr. |
| 4,367,526 | A | 1/1983 | McGeary et al. |
| 4,432,067 | A | 2/1984 | Nielsen |
| 4,815,020 | A | 3/1989 | Cormier |
| 4,864,592 | A | 9/1989 | Lee |
| 5,095,430 | A | 3/1992 | Bonito et al. |
| 5,153,826 | A | 10/1992 | Johnson |
| 5,507,485 | A | 4/1996 | Fisher |

FOREIGN PATENT DOCUMENTS

| | | |
|---|---|---|
| CA | 1264494 | 1/1990 |
| JP | 02-209173 | 8/1990 |
| JP | 03-15583 | 7/1991 |
| WO | WO 9003204 | 4/1990 |

OTHER PUBLICATIONS

"Eagle Scoremaster Golf Computer Easy to Use! Operating Instructions", published 1981.
"Sharp Electronic Organizer Model ZQ–5000 ZQ–5200 Operation Manual", published 1990.
Wiren, Ph.D., G. "The PGA Manual of Golf, The Professional's Way to Better Golf", published 1991.

*Primary Examiner*—Glenn K. Dawson

(57) ABSTRACT

A handheld computerized golf data recording, reporting and advising unit, and a method for its operation. The unit itself is a small, comfortably handheld computerized unit with a generally writable display and a simplified key control panel to enter and retrieve data. Using the key control panel, a golfer can selectively retrieve a number of pre-formatted screens corresponding to pre-game, game-interactive and post-game recording and reporting of golf facts statistics and general golf knowledge. The pre-game screens contain data input fields having predetermined sets of values a user selects to provide information required by the game-interactive and game-reporting screens and algorithms to process, store and report information. The information entered in the pre-game and game-interactive mode is automatically stored in the memory of the unit and subsequently formatted into one or more statistical reports upon request by the user.

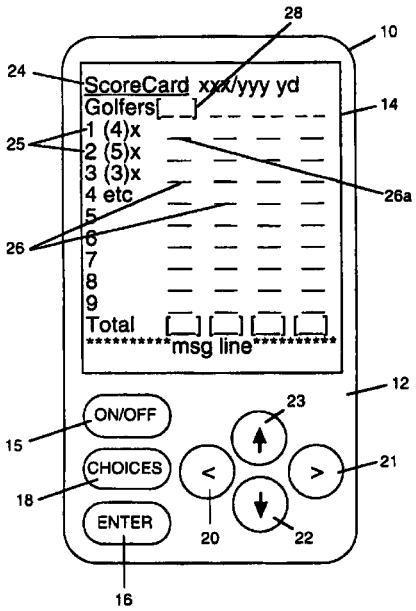

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–37 is confirmed.

1. An apparatus for recording and reporting golf information to increase a player's ability to improve from experience, the apparatus comprising:

a self-contained computer unit having a memory, a power source and a display for selectively displaying a plurality of information screens and associated data stored in the memory, the information screens including screen-dependent data input fields for the associated data;

key entry means for retrieving and selectively displaying the information screens from the memory on the display, and for retrieving, selecting, and recording the associated data with each information screen, wherein the key entry means includes first key means comprising one entry key for selectively displaying information screens, second screen-dependent field select key means for selecting a particular data input field of predefined data on a displayed screen, the second screen-dependent field select key means comprising two bi-directional tab keys for scrolling in opposite directions through the data input fields on a displayed information screen, and third screen-dependent value select key means for displaying and selectively recording or altering selected data in a selected data input field, the third screen-dependent value select key means comprising two bi-directional scroll keys for scrolling in opposite directions through the predefined data associated with the data input field on the displayed information screen.

* * * * *